US011380467B2

(12) United States Patent
Arnold et al.

(10) Patent No.: US 11,380,467 B2
(45) Date of Patent: Jul. 5, 2022

(54) AXISYMMETRIC ELECTROPERMANENT MAGNETS

(71) Applicant: University of Florida Research Foundation, Inc., Gainesville, FL (US)

(72) Inventors: David P. Arnold, Gainesville, FL (US); Camilo Velez Cuervo, Pittsburgh, PA (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 17/188,545

(22) Filed: Mar. 1, 2021

(65) Prior Publication Data

US 2021/0183553 A1 Jun. 17, 2021

Related U.S. Application Data

(63) Continuation of application No. 16/466,409, filed as application No. PCT/US2017/065145 on Dec. 7, 2017, now Pat. No. 10,971,292.

(60) Provisional application No. 62/431,239, filed on Dec. 7, 2016.

(51) Int. Cl.

| | |
|---|---|
| ***H01F 7/02*** | (2006.01) |
| ***H01F 7/20*** | (2006.01) |
| ***H01F 13/00*** | (2006.01) |

(52) U.S. Cl.

CPC ..... *H01F 7/0226* (2013.01); *H01F 7/20* (2013.01); *H01F 13/003* (2013.01)

(58) Field of Classification Search

CPC ..... H01F 13/003; H01F 7/0226; H01F 7/20

See application file for complete search history.

(56) References Cited

U.S. PATENT DOCUMENTS

| | | | |
|---|---|---|---|
| 3,079,535 | A | 2/1963 | Schultz |
| 5,631,618 | A | 5/1997 | Trumper et al. |
| 6,489,871 | B1 | 12/2002 | Barton |
| 6,707,360 | B2 | 3/2004 | Underwood et al. |

(Continued)

FOREIGN PATENT DOCUMENTS

| | | | |
|---|---|---|---|
| KR | 20140135800 | A | 11/2014 |

OTHER PUBLICATIONS

International Search Report for PCT/US2017/065145 filed Dec. 7, 2017.

*Primary Examiner* — Mohamad A Musleh

(74) *Attorney, Agent, or Firm* — Thomas | Horstemeyer, LLP

(57) ABSTRACT

Embodiments of the present disclosure relate to methods and systems for switching a magnetic field external to a magnet assembly having two permanent magnets, including a fixed permanent magnet portion and a switching permanent magnet portion, where a switching magnetic field is used to switch the magnetization of the switching permanent magnet portion, but not switch the magnetization of the fixed permanent magnet portion. In this way, the fixed permanent magnet portion has a fixed magnetization, such that the direction of magnetization of the fixed permanent magnet portion remains the same during switching of the magnetization of the switching permanent magnet portion, and the switching permanent magnet portion has a switching magnetization, such that the direction of magnetization of the switching permanent magnet portion is switched during switching of the magnetization of the switching permanent magnet portion.

20 Claims, 12 Drawing Sheets

(56) References Cited

U.S. PATENT DOCUMENTS

| | | | |
|---|---|---|---|
| 8,878,639 | B2 | 11/2014 | Kocijan |
| 9,324,487 | B1 | 4/2016 | Wei et al. |
| 10,173,292 | B2 | 1/2019 | Fullerton et al. |
| 2002/0093407 | A1 | 7/2002 | Harris |
| 2010/0237970 | A1 | 9/2010 | Liu |
| 2014/0049347 | A1 | 2/2014 | Barton et al. |
| 2014/0285930 | A1 | 9/2014 | Powell |
| 2015/0035632 | A1 | 2/2015 | Sarh et al. |
| 2015/0377574 | A1 | 12/2015 | Cooke et al. |

AXISYMMETRIC ELECTROPERMANENT MAGNETS

CROSS-REFERENCE TO RELATED APPLICATION

This application is a continuation of co-pending U.S. utility application entitled, "Axisymmetric Electropermanent Magnets," having Ser. No. 16/466,409, filed Jun. 4, 2019, which is the 35 U.S.C. § 371 national stage application of PCT Application No. PCT/US2017/065145, filed Dec. 7, 2017, which claims priority to, and the benefit of U.S. provisional application entitled "AXISYMMETRIC ELECTROPERMANENT MAGNETS" having Ser. No. 62/431,239, filed Dec. 7, 2016, all of which are hereby incorporated by reference in their entireties.

BACKGROUND

The first switchable magnet included two permanent magnets positioned between two soft magnetic shunt plates made of a magnetically permeable material (e.g., a ferromagnetic material), where one of the permanent magnets was mechanically rotated to align the directions of magnetization of the two permanent magnets in the same direction, or align the directions of magnetization of the two permanent magnets in opposite directions, in order to turn the switchable magnet "on" or the switchable magnet turn "off," respectively, where a magnetic latching field extended from the switchable magnet when the switchable magnet was on, and little or no magnetic latching field extended from the switchable magnet when the switchable magnet was off [3, 16].

An electropermanent magnet (EPM) is a type of switchable magnet where a switchable magnet is a magnet device where the magnetic field external to the device is switchable between an "on state" and an "off state". Rather than physically rotating one of two permanent magnets to switch the alignment of the directions of magnetization of the two permanent magnets, an electropermanent magnet includes a pair of permanent magnets positioned between two soft magnetic shunt plates made of a magnetically permeable material, where a pulse of electric current passing through a coil in a first direction is used to create a magnetic field that flips the direction of magnetization of the switchable permanent magnet to align the directions of magnetization of the two permanent magnets in the same direction, or a pulse of current passing through the coil in a second direction opposite to the first direction Hips the direction of magnetization of the switchable permanent magnet such that the directions of magnetization of the two permanent magnets are in opposite directions, in order to turn "on," or "off," respectively, a magnetic latching field of the EPM [14, 17]. In this way, an EPM is a switchable magnet that only consumes power during transitions between the on/off states, i.e., transitions from the on state to the off state and transitions from the off state to the on state. Switching the electropermanent magnets from the on state to the off state, and from the off state to the on state, controls the EPM's external magnetic (latching) field.

Electromagnets also can be used to create adjustable external magnetic fields, where the adjustable magnetic fields are created by driving an adjustable current through a coil. However, in contrast with an electromagnet, which requires continuous electric current to to electromagnets. Accordingly, EPMs can be advantageous in certain applications, such as when the amount of energy use is important.

Many of applications for EPMs benefit from the miniaturization of EPMs, such as the use of EPMs as: switchable magnetic components with application in MEMS; actuators/latches for microrobots and programmable matter [1]; and ferrofluid droplet manipulations in microfluidic devices [15].

EPMs are typically constructed using two adjacent permanent magnets and a soft magnetic material at each end of the two permanent magnets [1]. FIG. 1 shows a prior art EPM, where two permanent magnets, namely an Aluminum-Nickel-Cobalt (Alnico) magnet (Sintered Alnico 5 with a coercivity of 48 KA/m and a residual induction of 1.26 T) and a Neodymium-Iron-Boron (NdFeB) magnet (Grade N40 NIB with a coercivity of 1000 KA/m and a residual induction of 1.28 T), are attached to a soft magnetic material, namely iron pole pieces, at each end of the two permanent magnets [1]. The soft magnetic material, which is a magnetically permeable material such as a ferromagnetic material, is used to guide the magnetic flux from the ends of the two permanent magnetics, such that when the EPM is in the on state, magnetic flux external to the EPM can latch the EPM to an object, such as an object having a ferromagnetic material, and when the EPM is in the off state, magnetic flux circulates in the soft magnetic material of the device and there is little or no external magnetic flux.

FIG. 2 shows another orientation of two permanent magnets and two pieces of soft magnetic material (e.g., steel plates) that can be used to create a switchable magnet, where the external magnetic flux, in the on state, extends from the EPM from a side of the EPM further away from one of the two permanent magnets than the other permanent magnet. The structure of FIG. 2 differs from the structure of FIG. 1, as the external magnetic flux of the structure of FIG. 1, in the on state, extends from the EPM from aside of the EPM that is the same distance away from both permanent magnets. The alignment of the poles of the two permanent magnets controls the external magnetic field of the EPM, as shown in FIG. 2. When the poles of the two permanent magnets are parallel, such that the N and S poles of the two permanent magnets are oriented in the same direction (directions of magnetization are the same), the magnetic flux will escape the steel plates, creating an external magnetic field [2]. This orientation of the poles of the two permanent magnets (i.e., oriented in the same direction) will be considered the "on state" of the EPM, noting that if the poles of both of the two permanent magnets were reversed, i.e., N and S reversed for both permanent magnets, the EPM would also have an external magnetic field and would be in a "second on state", where the direction of the external magnetic field in the "second on state" is opposite to the direction of the external magnetic field of the "on state". However, once the direction of magnetization is established for one of the permanent magnets (the fixed magnet), this direction of magnetization does not typically change during operation of the EPM. When the poles of the permanent magnets are antiparallel, such that the N and S poles of the two permanent magnets are oriented in opposite directions (directions of magnetization are opposite), the magnetic flux is contained in the steel plates, such that there is no external magnetic field (or a substantially reduced external magnetic field). This will be considered the "off state" of the EPM, noting that if the poles of both of the two permanent magnets were reversed, i.e., N and S reversed for both permanent magnets, the EPM would still not have an external field and would be in a "second off state."

The alignment of the poles of the two permanent magnets is controlled for the prior art device shown in FIG. 1 using a single coil that wraps around both permanent magnets, through which a pulse of electric current passes in order to switch the magnetization of the switching magnet, without switching the magnetization of the fixed magnet. The two permanent magnets in FIG. 1 include an NdFeB (fixed) magnet and an Alnico (switching) magnet, in which the Alnico magnet has such a low coercivity relative to the coercivity of the NdFeB magnet that the electric current required to reverse the magnetization of the Alnico magnet is 1/100 of the electric current required to reverse the magnetization of the NdFeB magnet [1]. The magnitude and duration of the electric current passed through the single coil positioned around both the fixed permanent magnet and the switching magnet are selected such that the magnetic field created by the coil will only change the direction of magnetization of the Alnico (switching) magnet, and not the NdFeB (fixed) magnet. Switching the magnetization of the switching magnet, and not the fixed magnet, switches the EPM from on/off to off/on.

Alternatively, a coil can be positioned around only the switchable magnet and not the fixed magnet. Specifically, in other EPMs, the alignment of the poles of the two permanent magnets is controlled using a coil that wraps around only one of the two permanent magnets (the switching magnet), such that the magnetic field produced by the electric current passing through the coil is only applied to the switching magnet, and the magnetic field created by the coil will only change the direction of magnetization of the switching magnet. Switching the magnetization of the switching magnet, and not the fixed magnet, then switches the EPM from on/off to off/on.

EPMs have been used since the late 20th century on a macroscopic scale, such as on cranes to lift large pieces of metal without a continuous energy source [3]. In 2010, EPMs were first built on a significantly smaller scale, measuring at approximately 3 $mm^2$, for creating programmable matter blocks [2]. Controlling the external magnetic field of the EPM forced the blocks to attract, connect, and disconnect to form basic two-dimensional structures. Programmable matter has since been developed into more advanced structures beyond cubes [4]. The new programmable matter uses EPMs to assemble complex, abstract three-dimensional structures. However, these structures cannot be made smaller because the size of the EPMs restricts the scale (size) of the structures.

The controllable magnetic field of EPMs allows EPMs to be used in transportation. Legged robots have been developed with EPMs that connect to ferromagnetic materials, permitting the robots to climb structures made from steel [5]. The ability to control the strength of the external magnetic field also permits a circular wheel shape to be used to climb ferromagnetic structures for increased gripping and mobility [6][7]. In addition, EPMs can be used in connecting mechanisms in transportation. EPMs have been used in docking systems for underwater robots because the external magnetic field of the EPM can pass through the water [8]. EPMs have also been used in drone delivery systems, similar to how EPMs are used in a crane, where the EPMs on the drone, such as a quadcopter, can connect to a ferromagnetic material to attract, connect, and release an object [9].

EPMs have also been used in medical settings, where the properties of EPMs can help to anchor surgical instruments without inadvertently attracting other instruments [10]. Unlike permanent magnets, in which anchoring causes other magnets to be attracted to instruments, the electropermanent magnet can anchor instruments without affecting (attracting) other medical instruments.

EPMs were initially going to be used to assemble Google's Project Ara modular cell phone [11]. In the original design, EPMs were going to be used to connect modules to a skeleton and to remove them, without requiring a constant power source. This design allowed for a customizable smartphone that could be adapted without turning off the phone. After a series of failed drop tests in which the modules were unable to stay connected to the skeleton with EPMs, Google determined that their EPMs could not both be decreased in size and still retain strong magnetic fields [12]. Accordingly, there is a need for EPMs that are both small and retain strong magnetic fields.

BRIEF SUMMARY

Embodiments of the subject invention relate to a switchable magnet having a magnet assembly that incorporates:

at least one fixed magnet having a first direction of magnetization, from a south end of the at least one fixed magnet to a north end of the at least one fixed magnet, in a first direction, and at least one switching magnet having a second direction of magnetization from a south end of the at least one switching magnet to a north end of the at least one switching magnet, where the at least one fixed magnet and the at least one switching magnet are permanent magnets, and either:

(i) one or more fixed magnets of the at least one fixed magnet are positioned within a corresponding one or more bores through a first switching magnet of the at least one switching magnet; or (ii) one or more switching magnets of the at least one switching magnet are positioned within a corresponding one or more bores through a first fixed magnet of the at least one fixed magnet; and a coil positioned with respect to the magnet assembly such that:

(i) when the second direction of magnetization is in the first direction and a first coil current is passed through the coil for a first period of time, a first coil created magnetic field is created that switches the second direction of magnetization from the first direction to a second direction, where the second direction is an opposite to the first direction, and does not switch the first direction of magnetization; and (ii) when the second direction of magnetization is in the second direction and a second coil current, where the second coil current is in an opposite direction to the first coil current, is passed through the coil for a second period of time, a second coil created magnetic field is created that switches the second direction of magnetization from the second direction to the first direction, and does not switch the first direction of magnetization;

a first shunt plate and a second shunt plate, positioned with respect to the magnet assembly such that:

(i) when the second direction of magnetization is in the first direction, an on state fixed magnetic flux exits out of the north end of the at least one fixed magnet and enters the first shunt plate, an on state switching magnetic flux exits out of the north end of the at least one switching magnet and enters the first shunt plate, and an on state external magnetic flux exits out of the first shunt plate and enters the second shunt plate, such that the on state external magnetic flux creates an external on state magnetic field; and (ii) when the second direction of magnetization is in the second direction, an off state magnetic flux exits out of the north end of the at least one fixed magnet and enters the first shunt plate, an off state switching magnetic flux exits out of the north end of the at least one switching magnet and enters the second shunt plate, and an off state external magnetic flux exits out of the first shunt plate and enters the second shunt plate, such that the off state external magnetic flux creates an external off state magnetic field.

Embodiments of the switchable magnet are such that the one or more fixed magnets of the at least one fixed magnet are positioned within the corresponding one or more bores through the first switching magnet of the at least one switching magnet.

Embodiments of the switchable magnet are such that the one or more switching magnets of the at least one switching magnet is a first switching magnet, and the at least one fixed magnet is a first fixed magnet of the at least one fixed magnet, such that the first switching magnet is positioned within a bore through the first fixed magnet.

Embodiments of the switchable magnet are such that the one or more fixed magnets of the at least one fixed magnet are positioned within the corresponding one or more bores through the first switching magnet of the at least one switching magnet.

Embodiments of the switchable magnet are such that the one or more fixed magnets of the at least one fixed magnet is a first fixed magnet, and the at least one switching magnet is a first switching magnet of the at least one switching magnet, such that the first fixed magnet is positioned within a bore through the first switching magnet.

Embodiments of the switchable magnet are such that the first fixed magnet and the first switching magnet are concentric. Alternative embodiments of the switchable magnet are such that the first fixed magnet and the first switching magnet are not concentric.

Embodiments of the switchable magnet are such that the first fixed magnet and the first switching magnet are coaxial. Alternative embodiments of the switchable magnet are such that the first fixed magnet and the first switching magnet are not coaxial.

Embodiments of the switchable magnet are such that the on state switching magnetic flux is in a range of 95% to (1/0.95) %, 90% to (1/0.90) %, and/or 80% to (1/0.80) %, of the on state fixed magnetic flux.

Embodiments of the switchable magnet are such that the off state switching magnetic flux is in a range of 95% to (1/0.95) %, 90% to (1/0.90) %, and/or 80% to (1/0.80) %, of the on state switching magnetic flux.

Embodiments of the switchable magnet are such that the off state switching magnetic flux is in a range of 95% to (1/0.95) %, 90% to (1/0.90) %, and/or 80% to (1/0.80) %, of the on state switching magnetic flux.

Embodiments of the switchable magnet are such that the coil is positioned with respect to the magnet assembly such that:

(i) when the first coil current is passed through the coil for the first period of time, the first fixed magnet and the first switching magnet are exposed to the first coil created magnetic field; and (ii) when the second coil current is passed through the coil for the second period of time, the first fixed magnet and the first switching magnet are exposed to the second coil created magnetic field.

Embodiments of the switchable magnet are such that the coil is positioned with respect to the magnet assembly such that:

(i) when the first coil current is passed through the coil for the first period of time, the first switching magnet is exposal to the first coil created magnetic field, and the first fixed magnet is not exposed to the first coil created magnetic field; and (ii) when the second coil current is passed through the coil for the second period of time, the first switching magnet is exposed to the second coil created magnetic field, and the first fixed magnet is not exposed to the second created coil magnetic field.

Embodiments of the switchable magnet are such that the first fixed magnet is cylindrically shaped.

Embodiments of the switchable magnet are such that the bore through the first switching magnet is cylindrically shaped. Alternative embodiments of the switchable magnet are such that the bore through the first switching magnet has a rectangular cross section, is annular shape, an/or has other shape(s).

Embodiments of the switchable magnet are such that the first switching magnet is cylindrically shaped. Alternative embodiments of the switchable magnet are such that the first switching magnet has a rectangular cross section, is annular shape, an/or has other shape(s).

Embodiments of the switchable magnet are such that the first shunt plate and the second shunt plate are cylindrically shaped, find the first shunt plate and the second shunt plate are coaxial with the first fixed magnet and the first switching magnet.

Embodiments of the switchable magnet are such that the coil is cylindrically shaped. Alternative embodiments of the switchable magnet are such that the coil is cylindrically shaped.

Embodiments of the switchable magnet are such that the first coil created magnetic field is uniform within an interior of the coil, and the second coil created magnetic field is uniform within the interior of the coil. Alternative embodiments of the switchable magnet are such that the first coil created magnetic field is uniform within an interior of the coil, and the second coil created magnetic field is not uniform within the interior of the coil.

Embodiments of the switchable magnet are such that the coil is positioned adjacent to an exterior surface of a side of the first switching magnet. Alternative embodiments of the switchable magnet are such that the coil is positioned adjacent to an exterior surface of a side of the first fixed magnet.

Embodiments of the switchable magnet are such that the on state external magnetic field is symmetrical about a longitudinal axis of the switchable magnet, and the off state external magnetic field is symmetrical about the longitudinal axis of the switchable magnet. Alternative embodiments of the switchable magnet are such that the on state external magnetic field is not symmetrical about a longitudinal axis of the switchable magnet, and the off state external magnetic field is not symmetrical about the longitudinal axis of the switchable magnet, and can have a desired shape.

Embodiments of the switchable magnet are such that the on state external magnetic field is not symmetrical about a longitudinal axis of the switchable magnet, and, absent the presence of the first shunt plate and the second shunt plate, when the second direction of magnetization is in the first direction, an on state fixed magnetic flux exits out of the north end of the at least one fixed magnet and enters into the south end of the at least one fixed magnet, and an on state switching magnetic flux exits out of the north end of the at least one switching magnet and enters into the south end of the at least one switching magnet, so as to create an on state external magnet assembly created magnetic field, wherein the on state magnet assembly created external magnetic field is symmetrical about the longitudinal axis of the switchable magnet, the off state external magnetic field is not symmetrical about the longitudinal axis of the switchable magnet, and absent the presence of the first shunt plate and the second shunt plate, when the second direction of magnetization is in the second direction, an off state fixed magnetic flux exits out of the north end of the at least one fixed magnet and enters into the south end of the at least one fixed magnet and/or the south end of the at least one switching magnet, and an off state switching magnetic flux exits out of the north end of the at least one switching magnet and enters into the south end of the at least one switching magnet and/or the south end of the at least one fixed magnet, so as to create an off state magnet assembly created external magnetic field, wherein the off state magnet assembly created external magnetic field is symmetrical about the longitudinal axis of the switchable magnet.

Alternative embodiments of the switchable magnet are such that the off state magnet assembly created external magnetic field is not symmetrical about the longitudinal axis of the switchable magnet.

Embodiments of the switchable magnet are such that the first fixed magnet is made of NdFeB and the first switching magnet is made of Alnico. Alternative embodiments of the switchable magnet are such that the first fixed magnet is made of materials known to one of skill in the art and the first switching magnet is made of is made of materials known to one of skill in the art, where the coercivity of the first fixed magnet is higher than the coercivity of the first switching magnet.

Embodiments of the switchable magnet are such that the first fixed magnet has a length $L_F$ along a longitudinal axis of the first fixed magnet, the first switching magnet has a length $L_S$ along a longitudinal axis of the first switching magnet, $L_F$ is equal to $L_S$; and longitudinal axis of the first switching magnet is coextensive with the longitudinal axis of the first fixed magnet.

Embodiments of the switchable magnet are such that the latching force can exert a force on an object in the axial direction at the top or bottom of the switchable magnet such as the embodiment shown in FIG. 3, and/or exert a force on an object in the radial direction at the side of the switchable magnet, as shown in FIG. 3 or embodiments that incorporate end plates having an axially asymmetric shape to guide the magnetic flux to the side of the switchable magnet.

BRIEF DESCRIPTION OF FIGURES

FIG. 6A shows a comparison of the pulling force related to the field at distance=0 mm between the EPM with and without soft magnetic plates on top and bottom of the magnets, in the on state and off state, and FIG. 6B shows the B field norm contour plots, where the on configuration is shown on the left, the off configuration is shown on the right, the configuration with plates is shown on top, and the configuration without plates is shown on the bottom, of FIG. 6B.

FIG. 11A shows a top view. FIG. 11B shows a cross sectional view. FIG. 11C shows a front view of the EPM, including cap plates, and FIG. 11D shows a size comparison.

FIG. 13A shows top view MOI images. FIG. 13C shows calculated net magnetic flux produced by the two EPM configurations (NdFeB and SmCo) for different reversal field strengths (the inset in FIG. 13C shows selected MOI images from which the magnetic flux was calculated, where magnetization values were selected as a function of each fixed magnet coercivity ($H_c$)).

FIGS. 14A-14B show the demagnetization strength that turns each of the electropermanent magnets of FIGS. 12A-12B off (see graph of FIG. 14A), by identifying the demagnetization state of each one that generated the lowest surface force, and measured force at different distances from the EPM surface for on/off state (shown in FIG. 14B).

DETAILED DESCRIPTION

Figure 1:
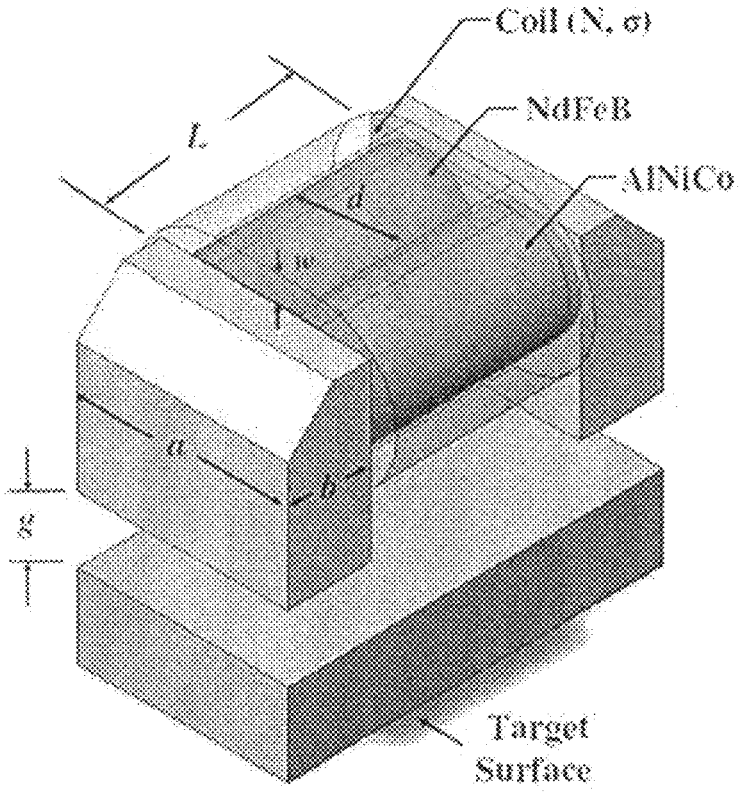
(PRIOR ART) FIG. 1
FIG. 1 shows a prior art electropermanent magnet configuration.

Embodiments of the subject invention relate to an electropermanent magnet core (EPM core) having two permanent magnets (or two permanent magnet portions where each portion can have one or more permanent magnets), including a fixed permanent magnet portion and a switching permanent magnet portion, where a switching magnetic field is used to switch the magnetization of the switching permanent magnet portion, but not switch the magnetization of the fixed permanent magnet portion. In this way, the fixed permanent magnet portion has a fixed magnetization, such that the direction of magnetization of the fixed permanent magnet portion remains the same during switching of the magnetization of the switching permanent magnet portion, given the magnitude and duration of the switching magnetic field used to switch the magnetization of the switching permanent magnet portion, and the switching permanent magnet portion has a switching magnetization, such that the direction of magnetization of the switching permanent magnet portion is switched during switching of the magnetization of the switching permanent magnet portion, given the magnitude and duration of the switching magnetic field used to switch the magnetization of the switching permanent magnet portion.

Embodiments of the subject invention relate to an electropermanent magnet (EPM) having two permanent magnets (or two permanent magnet portions where each portion can have one or more permanent magnets), including a fixed permanent magnet portion and a switching permanent magnet portion, where a switching magnetic field is used to switch the magnetization of the switching permanent magnet portion, but not switch the magnetization of the fixed permanent magnet portion. In this way, the fixed permanent magnet portion has a fixed magnetization, such that the direction of magnetization of the fixed permanent magnet portion remains the same during operation of the EPM, given the magnitude and duration of the switching magnetic field used to switch the magnetization of the switching permanent magnet portion, and the switching permanent magnet portion has a switching magnetization, such that the direction of magnetization of the switching permanent magnet portion is switched during operation of the EPM, given the magnitude and duration of the switching magnetic field used to switch the magnetization of the switching permanent magnet portion. Specific embodiments are directed to a switchable magnet that only consumes power during transitions between the on/off states, such that the switchable magnet, only consumes power while creating the switching magnetic field used to switch the magnetization of the switching permanent magnet portion.

In specific embodiments, the switching magnetic field is pulsed, preferably for time periods <1 s, <100 ms, <10 ms, <1 ms, <100 microseconds, <10 microseconds, <1 microsecond, and/or <100 ns, and at a magnitude of the switching magnetic field is at least a threshold magnitude that reverse the direction of magnetization of the portion of the switching magnet that is exposed to the switching magnetic field.

Specific embodiments are directed to an EPM incorporating an axisymmetric architecture for the two permanent magnets (i.e., the fixed permanent magnet and the switching permanent magnet). Specific embodiments are sub-millimeter in size. A specific embodiment is a sub-millimeter axisymmetric electropermanent magnet having a latching force on/off ratio of 784 with a total volume of 34 $mm^3$. Compared to conventional architectures, the axisymmetric design: (1) provides better performance in a smaller form factor, (2) has a symmetric magnetic field along the magnetization axis, as opposed to the asymmetric fields in the transverse direction, (3) facilitates microfabrication, and (4) allows large tunability of the magnetic field on/off ratio (therefore the force) as a function of design variables (e.g., radii and thickness).

The subject application describes modeling, optimization, and experimental evaluation of a sub-millimeter electropermanent magnet yielding an on/off force ratio of 784 with a total volume of 34 $mm^3$, corresponding to hundred-hold higher on/off force ratio than conventional EPM architectures in $1/10^{th}$ of the volume. Specific embodiments have been fabricated (i) using alnico as the switching magnet material and SmCo as the fixed magnet material, having an EPM volume of 3-8 $mm^3$ and a latching force ratio of 191, and (ii) using alnico as the switching magnet material and NdFeB as the fixed magnet material, having an EPM volume of 3.8 $mm^3$ and a latching force ratio of 303.

An embodiment is directed to a cylindrical electropermanent magnet that can be scaled down to microscopic sizes. In specific embodiments, the overall switchable magnet (EPM) diameter, or thickness, is <1 mm, <100 micrometers, and/or <10 micrometers. Embodiments of the subject EPM incorporate two permanent magnets, a Neodymium-Iron-Boron (NdFeB) magnet embedded inside an Aluminum-Nickel-Cobalt (Alnico) magnet, and two steel plates, one placed above the magnets and the other placed below the magnets. When the poles of the permanent magnets are parallel (same directions of magnetization), the steel plates act as poles of a permanent magnet combination, with the ability to attract ferromagnetic and paramagnetic materials and repel diamagnetic materials [1]. When the poles of the permanent magnets are antiparallel (directions of magnetization opposite), the magnetic field (magnetic flux) is contained within the steel plates and permanent magnets, and the steel plates are unable to interact with (create a force on) other magnetic materials.

The dimensions of an embodiment of an EPM, and the relative dimensions of subparts of the EPM, were optimized using Comsol Multiphysics simulations, by individually manipulating (varying) each of various parameters. The embodiment incorporates a cylindrical switching permanent magnet (Alnico) having a cylindrical bore therethrough along a central longitudinal axis of the Alnico magnet, with a cylindrical fixed permanent magnet (NdFeB) positioned in the bore, such that the Alnico magnet and the NdFeB magnet are concentric and have the same length, and are positioned at the same axial position. It was determined that important factors for creating an EPM that has a high holding force when the EPM is in the on position and a low holding force when in the off position were the thickness of the steel plates, the ratio of the volumes of the two permanent magnets, and the aspect ratio (L/D) of the permanent magnet assembly. The poles (direction of magnetization) of the Alnico magnet are reversed using a copper coil that wraps around the Alnico magnet, with the NdFeB magnet positioned within the Alnico magnet, and flips the magnetization of the Alnico magnet, without flipping the magnetization of the NdFeB magnet, due to the low coercivity of the Alnico magnet and the high coercivity the NdFeB magnet [2]. A current is passed through a separate electric circuit, and through the coil, to create a magnetic field to reverse the magnetization of the Alnico.

Figures 4A, 4B:
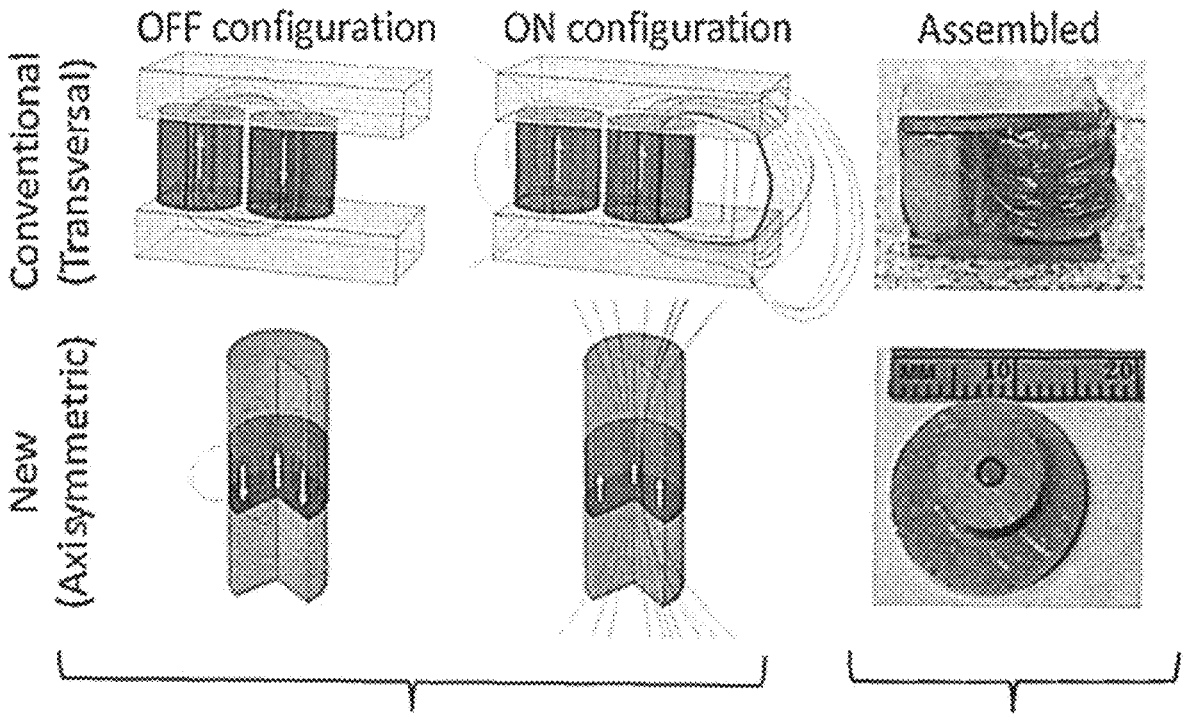
FIG. 4A shows a conventional EPM architecture (top) in the off state (left) and in the on state (right), and shows an axisymmetric EPM architecture (bottom) in accordance with an embodiment of the invention in the off state (left) and in the on state (right).
FIG. 4B shows an assembled version of a conventional EPM architecture (top), as shown in FIG. 4A, and an assembled version of an axisymmetric EPM architecture (bottom), with only one steel plate shown.

FIG. 4A shows the principle of operation for the traditional EPM (top), and compares the conventional architecture that produces a traverse field (transversal field architecture [17, 1, 15]) vs. an architecture (bottom) that produces an axisymmetric field (axisymmetric field architecture) in accordance with an embodiment of the subject invention. FIG. 4B shows fabricated examples of both the transversal field architecture and the axisymmetric field architecture. The axisymmetric field architecture shown in FIG. 4A generates external B fields and latching forces along the axis, using two concentric permanent magnets and two soft magnetic cap plates, or shunt plates.

Figure 3:
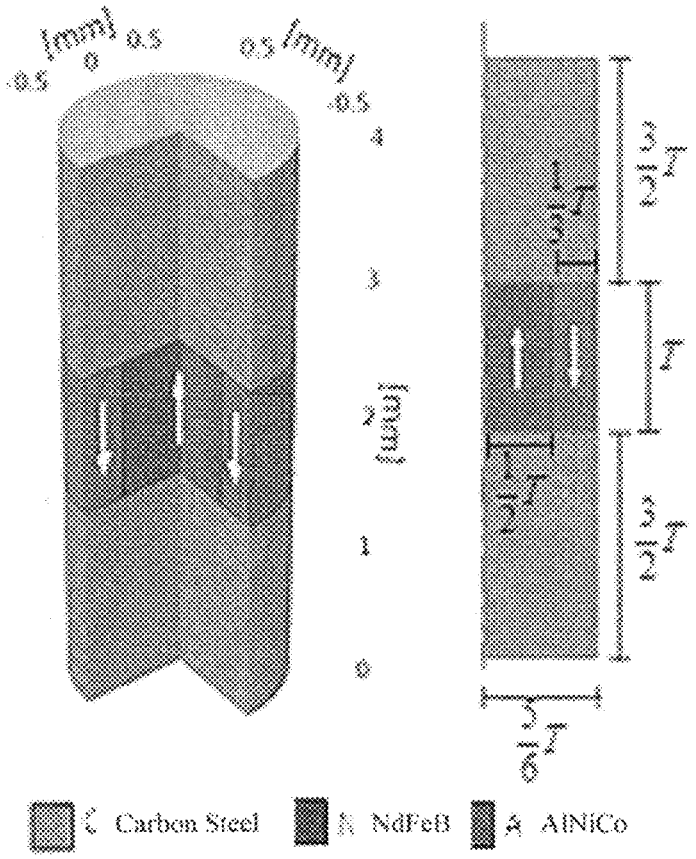
FIG. 3 shows an embodiment of an EPM in accordance with the subject invention, having a configuration with the recommended dimensions, and relative dimensions, for easy scalability, yielding a high latching force and a high latching force on/off ratio.

Using 2D simulations in COMSOL Multiphysics, the B fields and latching forces of both the transversal field architecture and the axisymmetric field architecture were studied as a function of several design variables, including: outer radius of cap plate, aspect ratio (L/D) of permanent magnet assembly (NdFeB and AlNiCo), ratio of radius of fixed permanent magnet (NdFeB) radius to radius of switchable permanent magnet (AlNiCo), and cap plate thickness. For the simulations, the following materials were assumed: grade N52 NdFeB as fixed (i.e., not switched) inner permanent magnet, grade 5 AlNiCo for the outer switching magnet, and mild/low-carbon steel (AISI 1018) for the cap plates. The cap plate thickness was found to be an important variable for tuning the on/off latching force ratio. FIG. 3 shows the dimensions of one embodiment as a function of the magnetic layer thickness (or length), where these dimensions were selected to maximize the on/off latching three ratio for a given cap plate thickness.

Embodiments can incorporate two permanent magnets, where the fixed permanent magnet is an Aluminum-Nickel-Cobalt (Alnico) magnet (Sintered Alnico 5 with a coercivity of 48 KA/m and a residual induction of 1.26 T) and the switchable permanent magnet is a Neodymium-Iron-Boron (NdFeB) magnet (Grade N40 NIB with a coercivity of 1000 KA/m and a residual induction of 1.28 T)

Figure 5:
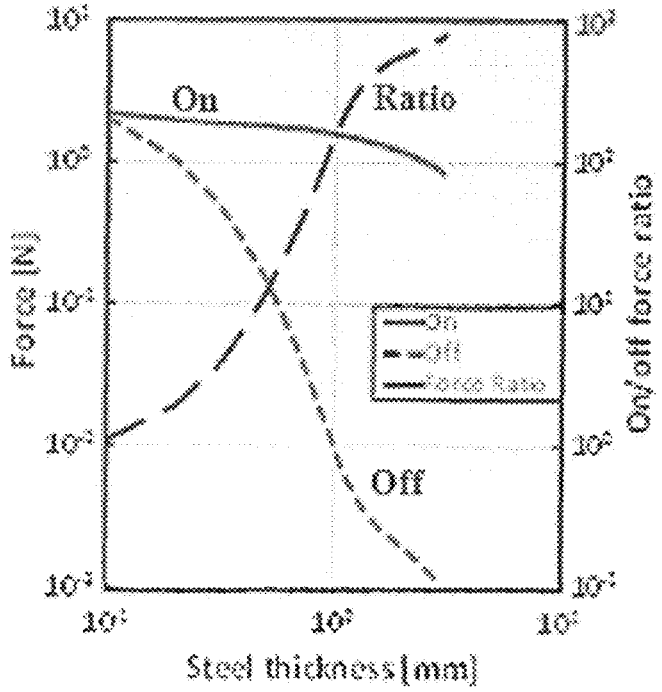
FIG. 5 shows the latching force generated by EPM's having different steel plate thicknesses (on and off states) vs. thickness of the steel plates for the embodiment of FIG. 3, along with the on/off ratio vs. thickness of the steel plates, showing that the thickness of the steel plates can independently control the off force.
Figure 6A:
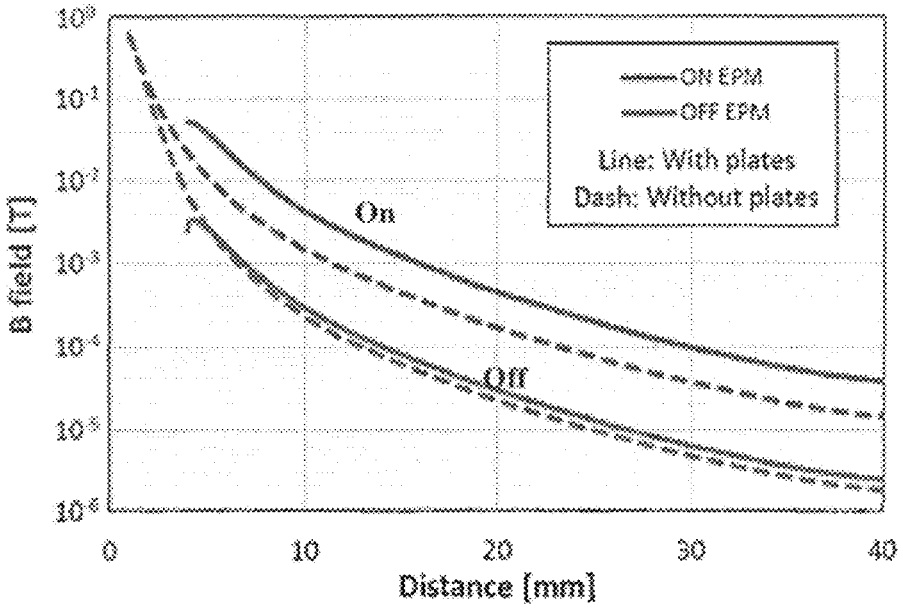
FIGS. 6A-6B show the results of a 2D axisymmetric COMSOL simulation, where
Figure 6B:
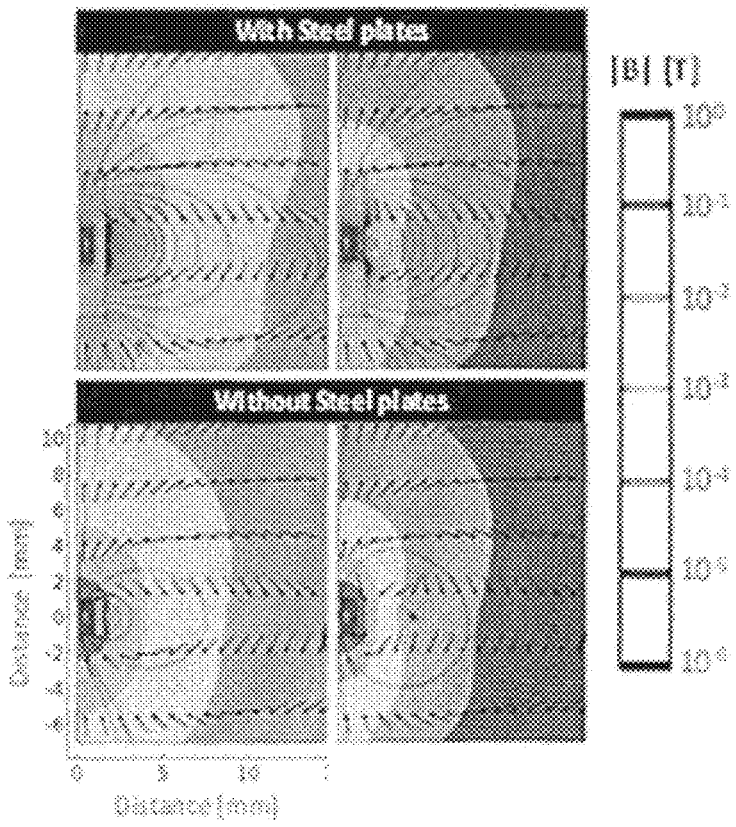

Simulations of the external magnetic field of the optimal EPM evidenced ~10× difference in external B field near the EPM poles in the on/off states (FIGS. 6A and 6B). FIG. 6A shows the magnitude of the on/off B-fields along the central axis with and without the cap plates. Additional modeling was used to determine the latching force to a semi-infinite steel plate. FIG. 5 shows how the on/off latching force ratio can be tuned by changing the thickness of the cap plates. Simulations of the configuration (dimensions used in FIG. 3) suggest an on/off force ratio of 450, with the ability for tuning this ratio from 1 up to 784, for sizes between 8 $mm^3$ and 34 $mm^3$, respectively. In a specific embodiment, an EPM having an axisymmetric design has a hundred-hold higher latching force ratio than a conventional EPM having a transversal field architecture, in $1/10^{th}$ the volume.

The materials for fabricating the EPMs shown in FIG. 4B include grade N52 NdFeB (K&J Magnetics and BJA) as fixed magnets, grade 5 Alnico (Magnet Kingdom) for the switching magnet, mild/low carbon steel (AISI 1018) for the top and bottom shunt plates, and copper for the coil. All magnetic materials were machined using a fine-precision Computer Numerical Control (CNC) Sherline 2000 using 1.55 mm diameter end mill tips.

The magnets were secured using crystal bond glue, which was removed after fabrication. The carbon steel was held in place using clamps. During fabrication, oil was applied to the steel and pressurized air was released when buildup accumulated around the tip. After fabrication, the pieces were sanded to remove any sharp edges or abnormalities.

Coil windings were wound around the AlNiCo magnets by fastening the AlNiCo magnets to two plastic plates using superglue and wrapping the copper wire around the magnets. After the coils were wrapped, the ends of the coil were secured and the plastic plates were removed. The resistance and inductance of the coil were measured with the Tongui LCR Meter TH2811D to determine the maximum current that could be safely passed through the coil. The EPM was constructed using the NdFeB magnet and the AlNiCo magnet with the coil wrapped around it. A measuring setup was assembled to electrically switch the conventional EPM transversal field architecture configuration.

A specific embodiment of a method of making an EPM core can include:

start with first magnetic material for switchable (or fixed);

demagnetize the first magnetic material, which allows magnetic powder to be introduced into the bore;

create a bore into, and preferably through, the first magnetic material (before or after demagnetization); and position a second magnetic material at least partially into bore, to create a fixed magnet.

The switching magnet can be demagnetized in this method by applying a magnetic field opposite to the magnetization, where the field amplitude exceeds the material coercivity of the switching magnet, or by subjecting the switching magnet to a temperature that is close to or exceeds the material Curie temperature of the switching magnet (an intrinsic property of the switching magnet magnetic material). Further embodiments can then add a top shunt plate at top of EPM core and/or add a bottom shunt plate at bottom of EPM core. Still further embodiments can a coil positioned with respect to the EPM core, or the EPM core with one or two shunts plates, so as to apply the switching magnetic fields when driven with a switching coil current.

FIGS. 6A-6C show the results of the 2D COM SOL model used for simulation and illustrate the importance of the shunt plates to obtain a high on/off pulling force ratio. The on/off force ratio vs. steel thickness shown in FIG. 6A illustrates the importance of the steel shunt plate thickness to control and tune the on/off force ratio of the EPM, where the on/off force ratio is an important parameter for the switchable device.

The simulation results and measurement results from the manually assembled EPM devices (shown in FIG. 4R) were used to compare EPMs having the conventional transversal field architecture and EPMs having the axisymmetric field architecture shown in FIG. 3, to establish design criteria, and to examine the importance of the following design variables: aspect ratio (D/L) of the magnet assembly, ratio of the NdFeB magnet radius and the AlNiCo magnet radius, soft magnetic shunt plate thickness and radius. A design model was then generated where the driven parameter was the thickness (or length of the cylindrical permanent magnet assembly) of the magnetic layer (T), and where the on/off force ratio can be trimmed (adjusted) by changing the thickness of the soft magnet shunt plates (end caps). Geometrical relationships between each component are shown in FIG. 3 (as a function of T) to obtain a simulated on/off force ratio of 450. A measure of the B fields generated by a 376 $mm^3$ conventional EPM at on/off position (38 mT/18 mT), evidences a 1.3 on/off force ratio. In contrast, simulations of the axisymmetric field architecture configuration indicate an on/off force ratio that can be tuned from 1 up to 784, for sizes between 8 $mm^3$ and 34 $mm^3$, respectively.

Figure 2:
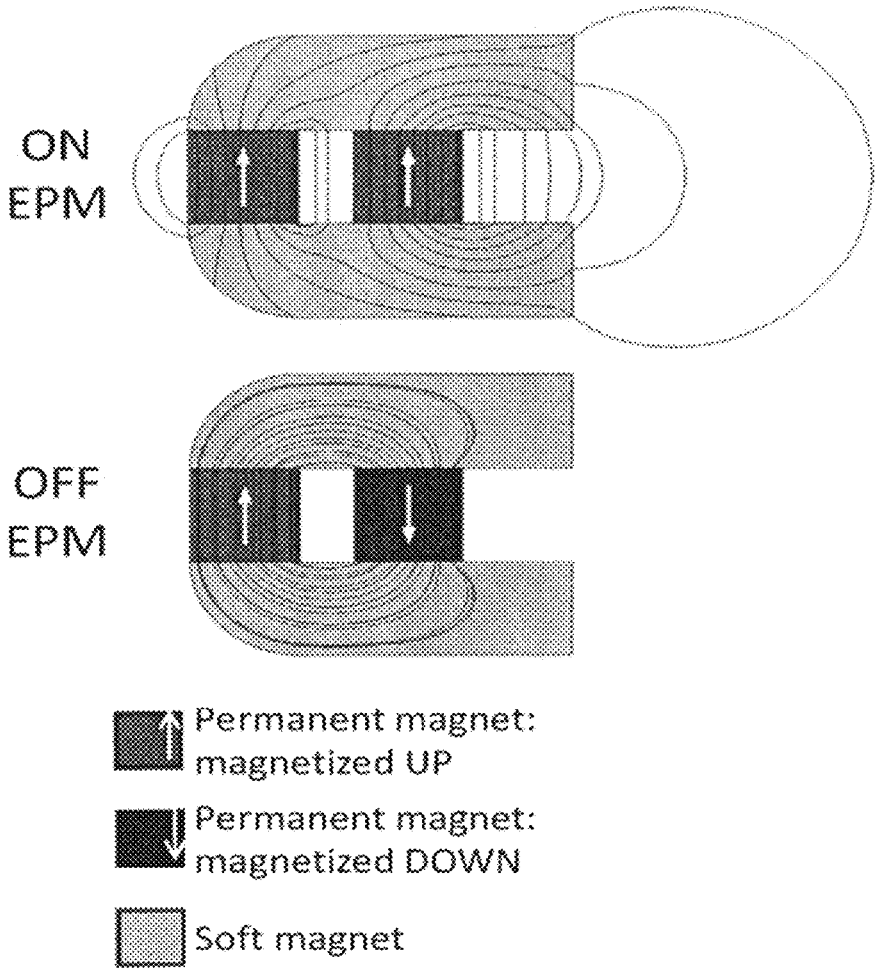
FIG. 2 shows the basic operational principle of an EPM, where the on configuration is shown at the top of FIG. 2 and the off configuration is shown at the bottom of FIG. 2.

Embodiments of the invention are directed to an EPM that can be built at a microscopic scale, e.g., the overall switching magnet (EPM) diameter, or thickness, can be <1 mm, <100 micrometers, and/or <10 micrometers, without substantially losing the strength of the magnetic field. An embodiment of the electropermanent magnet includes a cylindrical NdFeB magnet embedded in a cylindrical AlNiCo magnet. On the top and bottom (i.e., each end of the cylindrical permanent magnets) are two end caps made of a ferromagnetic material (made of low-carbon steel), forming a small EPM, as shown in FIG. 3 (FIG. 3 shows a magnet assembly with an NdFeB magnet having D=T, L=T positioned in a bore through an AlNiCo magnet having D=(10/6)T, L=T, with steel end caps having D=(10/6)T, L=(3/2) T at each end of the cylindrical magnet assembly). A coil surrounding the switchable permanent magnet, or both permanent magnets, when driven with a short pulse of electrical current, reverses the magnetic field of the switchable permanent magnet, which turns the external magnetic field of the EPM on or off. The cylindrical shape having two concentric permanent magnets, rather than having two adjacent permanent magnets (as shown in FIG. 1 and FIG. 2), allows the EPM to be scaled down to smaller sizes. When the dimensions of the EPM stay proportional (i.e., scaled to T as shown in FIG. 3), the strength of the magnetic field the EPM produces is close to the strength of the magnetic field of the EPM at larger dimensions. Unlike conventional EPM designs, the EPM shown in FIG. 3 is axisymmetric, which makes the EPM more efficient. The EPM configuration of the embodiment shown in FIG. 3 was arrived at by finding the ratio of the holding force while the EPM is in the on position to the holding force while the EPM is in the off position, which is referred to as the on/off holding force ratio, such that the on/off holding force ratio is maximum for a certain end cap thickness.

To optimize the EPM axisymmetric field architecture configuration, simulations were run in Comsol Multiphysics 5.2a. Dimensions of the EPM were manipulated individually, and then the dimensions indicated were used in simulations. The parameters that were changed included the aspect ratio (L/D) of the magnet assembly (where D is the diameter and L is the length of the cylindrical magnet assembly), the ratio of the radius of the steel plates to the outer radius of the Alnico magnet, the ratio of the radius of the NdFeB magnet to the radius of the AlNiCo magnet, and the thickness of the steel plates. The efficacy of the configurations was determined by finding the holding force in the on position and dividing it by its holding force in the off position to find the on/off holding force ratio. Two-dimensional axisymmetric simulations were used to simulate three-dimensional configurations to minimize the time spent running simulations.

The properties of the NdFeB magnets, the AlNiCo magnets, and the steel plates were measured using the GMW Magnetic Systems Model 3473-70 Vibrating Sample Magnetometer (VSM) by measuring the magnetization of the materials with the change in the external B-field applied to the material. To measure the materials, each magnet was magnetized up out of plane and the materials were attached to glass probes using double-sided tape. The properties of the magnets and steel plates were measured out of plane and inputted into the simulations using the procedures described in [1][2].

After running simulations to select the EPM configurations, the EPMs shown in FIG. 4B were constructed, and connected to a separate electric circuit. In the circuit, power from an Agilent E3616A DC Power Supply flowed through a resistor and a double button switch. The switch powered the capacitor, which was released with a slide switch through a resistor. The direction of the current was controlled with a slide switch that directed the electric current through the coil. The magnetic field was measured at the surface with a Lake Shore 475 DSP Gaussmeter and the maximum current flow between the capacitor and the coil was measured using a Tektronix DPO 2004B Digital Phosphor Oscilloscope and Tektronix TCPA 3000 AC/DC Current Probe. The procedures were repeated again with the current flowing in the opposite direction to reverse the magnetization of the AlNiCo magnet again. The voltage stored in the capacitor was slowly lowered to find the lowest electric current necessary to completely reverse the magnetization of the AlNiCo magnet of the EPM.

The holding force of the embodiment of the subject EPM shown in FIG. 4B (bottom) and the conventional transversal field EPM shown in FIG. 4B (top) were also tested in the on and off configurations. The EPMs were attached to steel plates above and below the EPMs and a bucket was attached to the bottom steel plate. Mass was added to the bucket until the EPM detached from either the top steel plate or the bottom steel plate, and the mass added to the bucket was used to determine the holding force in each configuration.

Figure 7:
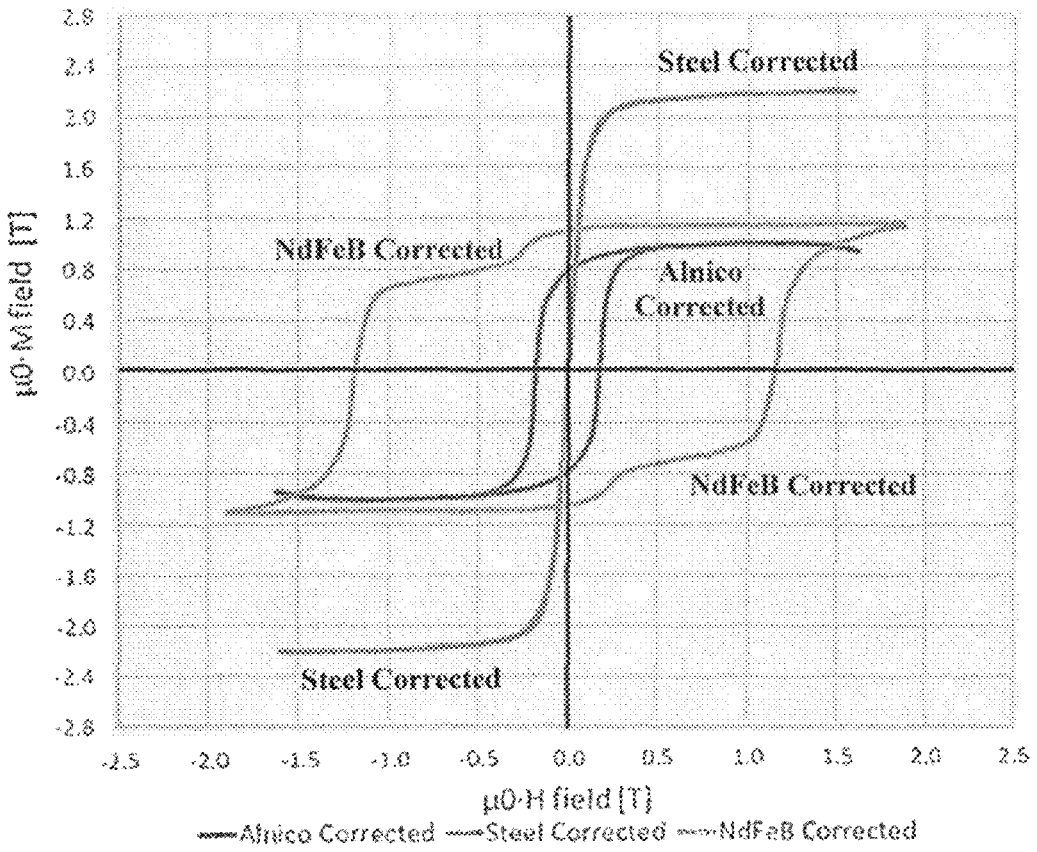
FIG. 7 shows magnetization vs. applied external magnetic field for Alnico, NdFeB, and steel, measured using a vibrating sample magnetometer.

FIG. 7 shows the data obtained from the vibrating sample magnetometer of the magnetization of AlNiCo, NdFeB, and steel with respect to the applied external magnetic field. It can be observed from the graph that the retentivity of the NdFeB magnet is larger than the coercivity of the AlNiCo magnet. The saturation of the NdFeB magnet is greater than the saturation of the AlNiCo.

Figure 8:
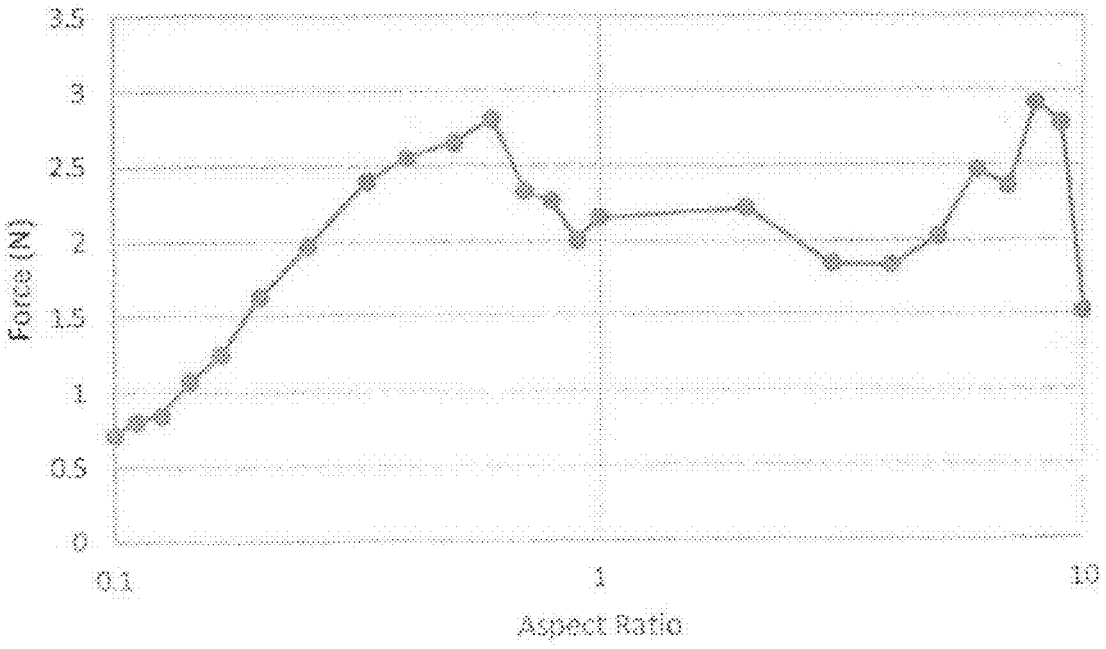
FIG. 8 shows the latching force vs. aspect ratio of the permanent magnet assembly, for the structure shown in FIG. 3.

The aspect ratio of the permanent magnet assembly was varied while keeping the volume of the magnet assembly constant and plotted on the logarithmic graph shown in FIG. 8. The force is maximized when the aspect ratio (L/D) of the magnet assembly is 0.6 (e.g., L=T, D=(5/6)T+(5/6) T, and (L/D)=T/(10/6)T=0.6 as shown in FIG. 3), and when the aspect ratio is 8. On either side of a maximum, the force rapidly decreases.

Figure 9:
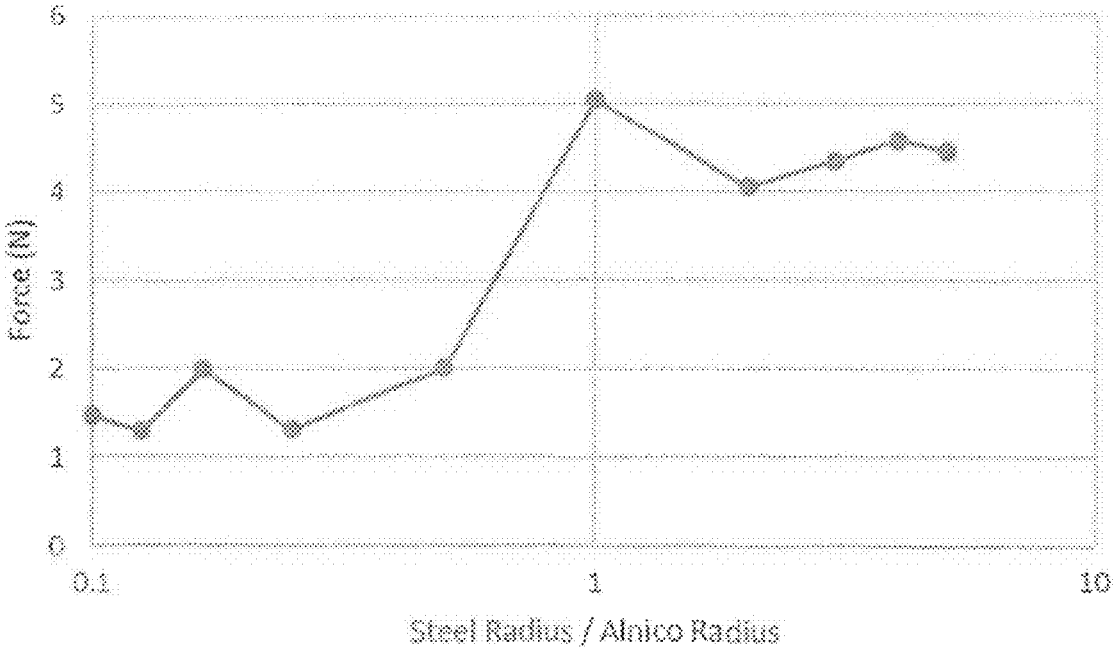
FIG. 9 shows the latching force vs. ratio of radius of the end plates (steel plates shown in FIG. 3) to outer radius of the permanent magnet assembly, which for the structure shown in FIG. 3 is the outer radius of the switchable magnet (Alnico magnet).

When the ratio of the radius of the steel to the outer radius of the AlNiCo was simulated, the force was maximized when the radius of the steel was equal to the outer radius of the AlNiCo, as can be seen in the logarithmic graph in FIG. 9. When the radius of the steel is greater than the radius of the AlNiCo, the force is lower, but not significantly less. However, when the radius of the steel is less than the outer radius of the AlNiCo, the force significantly decreases.

Figure 10:
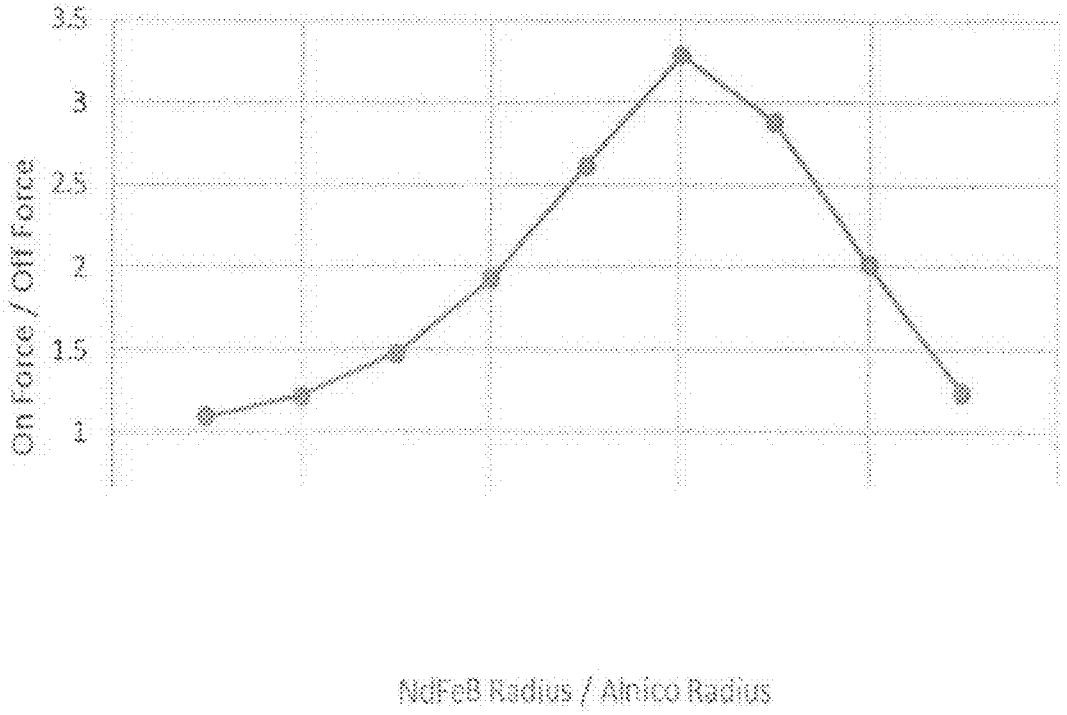
FIG. 10 shows the on/off force ratio vs. ratio of the fixed permanent magnet (NdFeB) to the outer radius of the switchable permanent magnet (Alnico), for the structure shown in FIG. 3.

The on/off holding force ratio was maximized when the ratio of the radius of the NdFeB to the radius of the AlNiCo was 0.6 (e.g., (1/2)T/(5/6)T as shown in FIG. 3), and rapidly declined when the ratio was above or below this value, as shown in FIG. 10 (FIG. 10 shows the ratio of two permanent magnets from 0 to 1 in 0.2 increments).

When plotted in a double logarithmic graph, as shown in FIG. 5, the holding force in the on position of the EPM slowly decreases when the thickness of the steel is decreased, before beginning to rapidly decrease at approximately 1.4 ratio of thickness of steel to thickness of magnet; however, the force in the oil position exponentially decreases with an increase in thickness of steel. Thus, the on/off holding force ratio exponentially varies with the thickness of steel until a radius of steel to radius of AlNiCo ratio of 1.4 is achieved, in which the on/off holding force ratio increases linearly with thickness of the steel.

Rectangular EPMs were constructed and tested. 40 V were used to reverse the magnetization of the AlNiCo, but it was not enough to completely reverse the magnetization of the AlNiCo. When the AlNiCo magnet was fully magnetized, lire field strength at the surface was approximately 38 mT, but the field strength at the surface was only approximately 18 mT when reversed electrically. The on/off holding force ratio was 1.3 in this configuration.

An embodiment of the invention relates to a cylindrical EPM as shown in FIG. 3, having an on/off holding force ratio of 450.

The properties of the NdFeB, AlNiCo, and steel limit the EPM configurations that can be constructed and effectively be turned on and off. Because the retentivity of the NdFeB magnet is larger than the coercivity of the AlNiCo magnet, the NdFeB magnet has the potential to inadvertently reverse the magnetization of the AlNiCo magnet. In specific embodiments, the size of the NdFeB magnet is restricted such that the volume of the NdFeB magnet is less than or equal to the volume of the AlNiCo magnet. Similarly, because the saturation of the NdFeB magnet is greater than the saturation of the AlNiCo magnet, the AlNiCo magnet must be larger than the NdFeB to counter the magnetic field of the NdFeB magnet.

FIGS. 3 and 5 show that the on/off holding force ratio of the EPM increases by increasing the thickness of one or both of the steel plates on either side of the EPM. Increasing the thickness of the steel plates exponentially decreases the holding force of the EPM in the off position while only slightly linearly decreasing the holding force of the EPM in the on position. Beginning when the ratio of the thickness of the steel to the thickness of the magnet is approximately 1.4, the holding force when the EPM is in the on position begins to decrease faster, decreasing the efficacy of the EPM.

The ratio of the radius of the NdFeB magnet to the radius of the AlNiCo magnet, illustrated in FIG. 3, also has a significant impact on the on/off holding force ratio of the EPM, as can be observed in FIG. 10. The maximum on/off holding force ratio peaks at the ratio of the radius of the NdFeB magnet to the radius of the AlNiCo magnet of 0.6, but such on/off holding force ratio rapidly declines when the ratio of the radius of the NdFeB magnet to the radius of the AlNiCo magnet is above or below this value.

Other important parameters that impact the performance of a cylindrical EPM with a high on/off holding force ratio are the aspect ratio of the NdFeB magnet and the ratio of the radius of the steel to the radius of the AlNiCo magnet. As shown in FIG. 8, the holding force of the EPM is strongest when the ratio of the length (L) of the magnet assembly to the diameter (D) of the magnet assembly is 0.6 or 8 (e.g., T/(10/6)T as shown in FIG. 3). A ratio of 8 is difficult to fabricate and fragile to use, so the ratio of 0.6 was used in the experiment. The on/off holding force has a less significant impact on the on/off force ratio of the EPM, but the force ratio of the EPM is maximized when the radius of the steel is equal to the outer radius of the Alnico magnet, as shown in FIG. 9.

Experimental testing showed that the magnetization of the AlNiCo can be reversed with an electric current passing through the coil, without reversing the magnetization of the NdFeB. An EPM in accordance with the subject invention having a rectangular configuration was used due to difficulties in machining AlNiCo magnets. The on/off holding force ratio of the rectangular EPM was 1.3, which is too low to be considered effective. However, the magnetization of the AlNiCo magnet was only partially reversed, which reduced the on/off holding force ratio, but smaller EPMs require less current to reverse the magnetization of the AlNiCo magnet.

Example 1

Figure 11A:
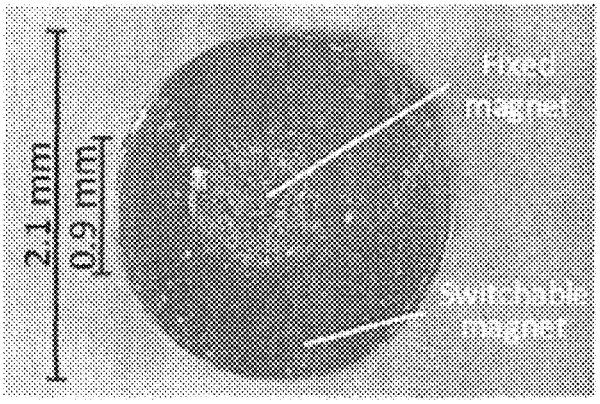
FIGS. 11A-11D show an embodiment of an EPM core, fabricated in accordance with an embodiment of a method of fabrication of the subject invention, where
Figure 11B:
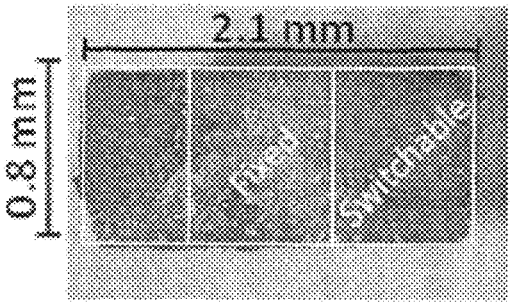
Figure 11C:
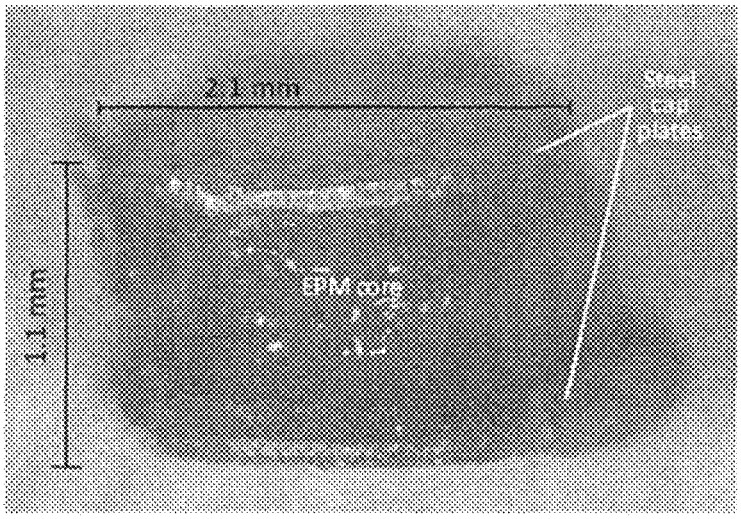
Figure 11D:
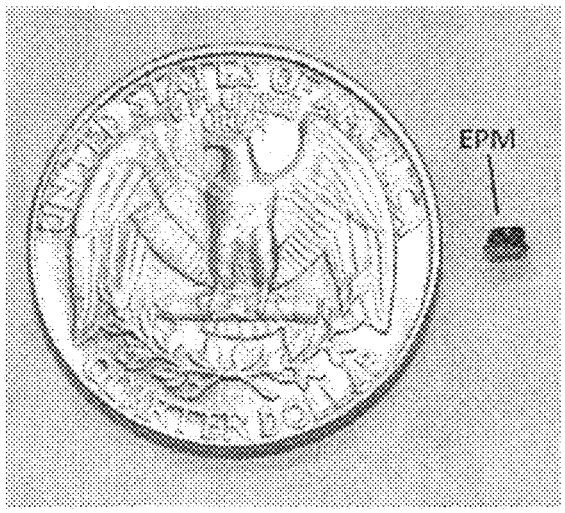

A specific embodiment of a magnet assembly (EPM core) is shown in FIGS. 11A-11B, and the magnet assembly with shunt plates (EPM) is shown in FIGS. 11C-11D. In the axisymmetric EPM, a ring-shaped switching magnet (outer magnet) surrounds a cylindrical fixed magnet (inner magnet). The concentric magnets are fabricated by punching an ~1 mm diameter hole (using a cutting cannula) in a 0.8-mm-thick rubber-bonded iron oxide substrate (which forms the switching magnet magnetic material), previously demagnetized. The fixed magnet is fabricated in the hole by bonding a high-coercivity, rare-earth permanent magnet powder (~15 μm $Sm_2Co_{17}$ particles or 6 μm NdFeB particles) and cyanoacrylate glue as bonding agent (applied on both ends). Finally, an annular ring having ~2 mm outer diameter is punched out of the rubber bonded iron oxide substrate, resulting in the two-magnet assembly called the EPM core. For the fully assembled EPMs, two steel cap plates (shunt), 125 μm thick, were glued to the top and bottom of the magnet assembly before punching the EPM core to guaranty self-align and uniform diameter of cap plates.

Figure 12A:
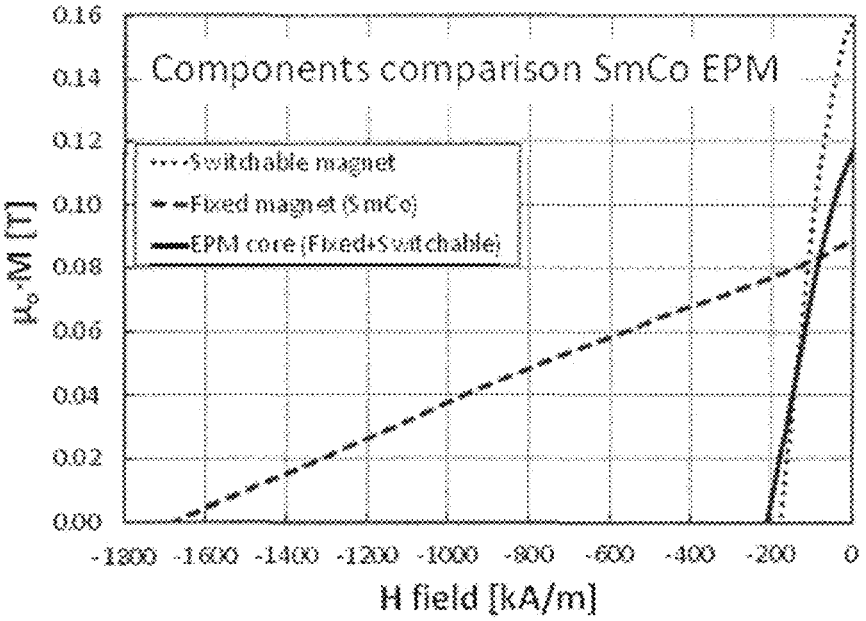
FIGS. 12A-12B show a second quadrant magnetization curve (VSM) for two EPM core configurations and the components of the EPM cores, where each graph represents the magnetization of the bonded magnet assembly, the switching magnet, and the fabricated EPM core (fixed magnet), where FIG. 12A relates to a fixed magnet made of SmCo, and FIG. 12B relates to a fixed magnet made of NdFeB.
Figure 12B:
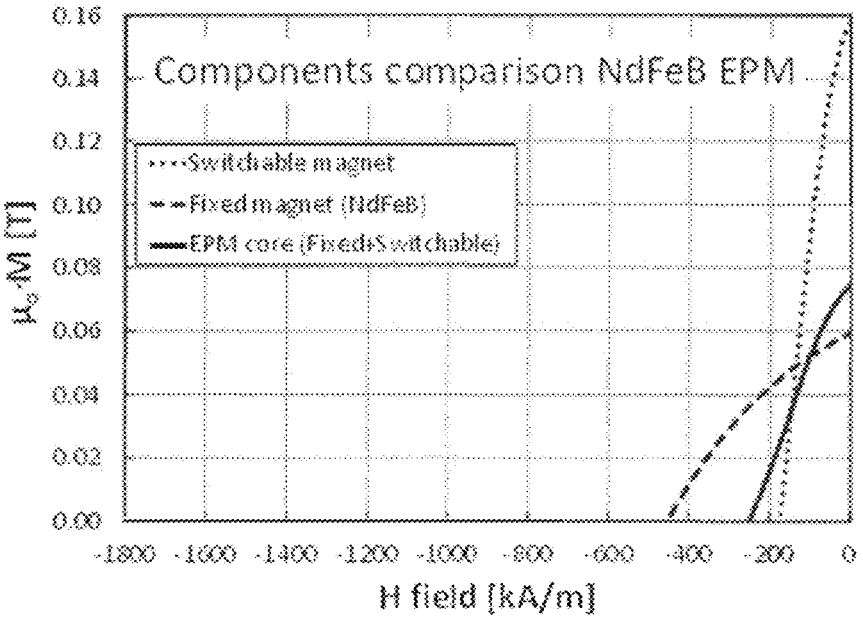

The functionality of the embodiment was demonstrated as explained. The EPM cores were magnetically characterized by using a vibration sample magnetometer (VSM, ADE Technologies EV9), where FIGS. 12A-12B present a comparison of the magnetization curves for the EPM core (without caps) and the individual components (switchable and fixed bonded magnets) of the EPM cores. The SmCo EPM yielded a higher remanence ($\mu_0$Mr=117 mT) and lower intrinsic coercivity ($H_{cJ}$210 kA/m) than the NdFeB EPM (75 mT and 252 kA/m).

Figure 13A:
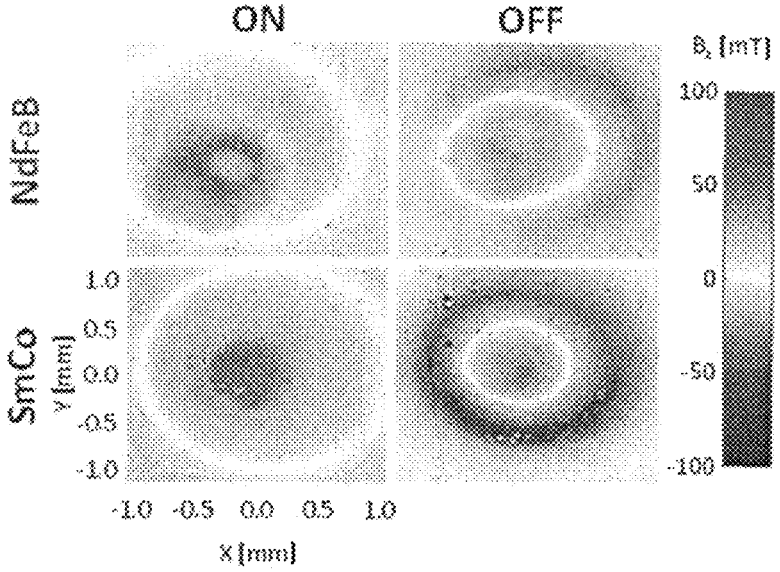
FIGS. 13A-13C show stray magnetic field (MOI) for on and off states of the two EPM of FIGS. 12A-12B, where the two configurations with different bonded (fixed) magnets (NdFeB and CmCo) were measured, where
Figure 13B:
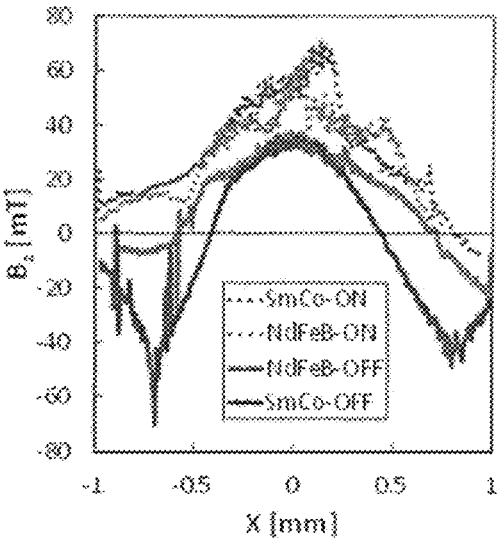

Additional magnetic characterization was performed by obtaining magneto optical images (MOI) and using a pulse magnetizer to switch the EPM cores from the on state (pulsing 7 T in the axial direction) to the off state (by pulsing −700 mT for SmCo or −440 mT for NdFeB EPMs). MOI characterization (shown in FIG. 13A) of EPMs at on/off states demonstrated there exists a reversal magnetic held (>300 mT for SmCo or >430 mT for NdFeB) capable of reversing the magnetization of the switching magnet without affecting the fixed magnet. Cross section measurements of the B field (shown in FIG. 13B) suggest that the average on/off ratio of on-state magnetic field to off-state magnetic field of the magnet assembly (EPM cores) for the SmCo (27.3 mT/−6 mT) and NdFeB (23 mT/8.3 mT) EPM cores are 4.6 and 2.8, respectively.

Figure 13C:
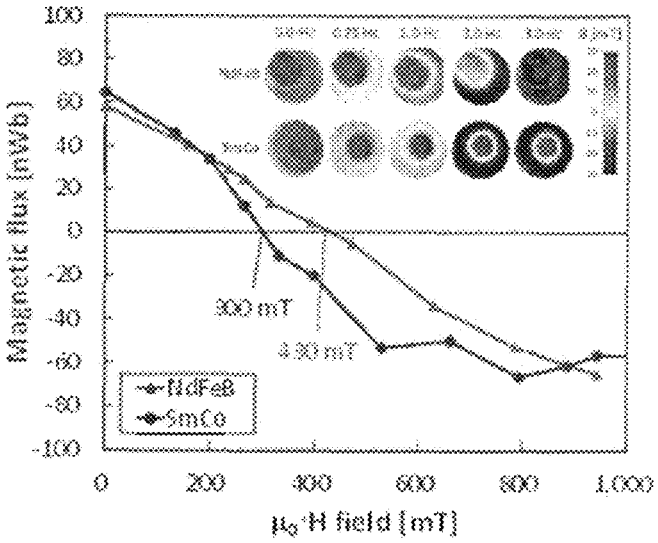

From the MOI images is it possible to calculate the magnetic flux (in units of nWb) produced by the EPM core when magnetized at different reversal magnetic fields (shown in FIG. 13C) and to report the magnetic flux on/off ratios. A full magnetization of (7 T) was applied before applying different reverse (switching) magnetic fields (using VSM) to each EPM core before measurement. FIG. 13C demonstrates that there exists a reversal magnetic field that cancel completely the magnetic flux of the EMP. This "off" state can be obtained from the EPM. This reversal magnetic field to turn the EPM off is >430 mT for the NdFeB sample and >300 mT for the SmCo sample.

Fully assembled EPMs with the steel cap plates were also used to measure the magnetic flux in the on/off state (by applying the reversal magnetic fields described above). An EPM that can be turned "on" and "off" and have a magnetic flux on/off ratio of ∞2 was achieved for both fixed magnet materials.

Figure 14A:
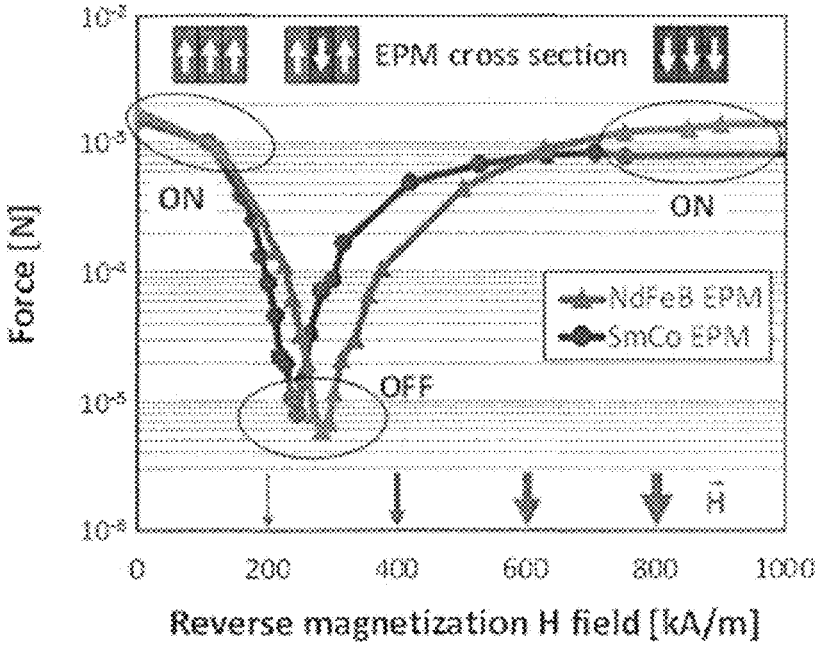
Figure 14B:
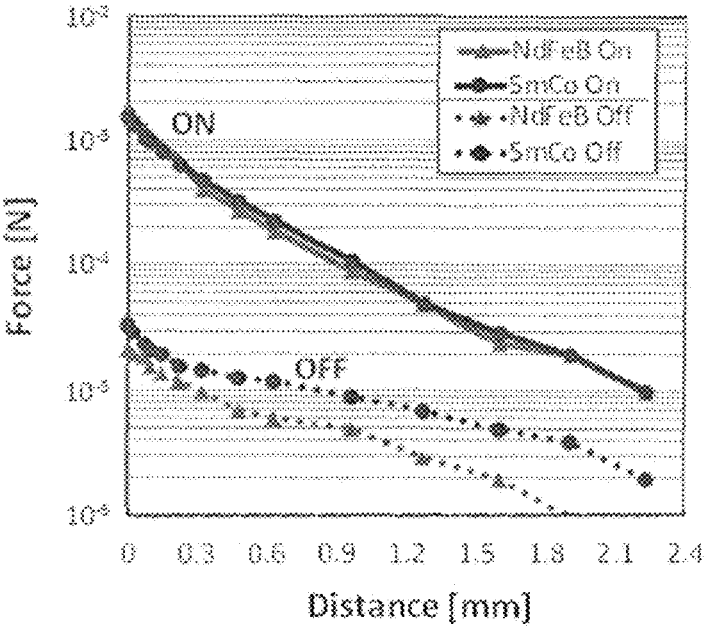
FIG. 14B shows a cross section measurement over the X axis.

An assembly of a microbalance (Explorer 2, Ohaus) with an automated 3D micro positioner (built with Newport DC servo controllers) was implemented as a variation of experiments proposed by [8], to measure the latching force between the EPM and an approximately infinite ferromagnetic plate (mild/low-carbon steel AISI 1018). By cautiously lowering the EPM over the ferromagnetic plate, the latching force raises the plate away from the balance and the force is registered as weight in the balance. FIG. 14A illustrates the latching force of the EPMs after applying different reversal magnetic fields (using VSM), demonstrating latching force on/off ratios of 191:1 (SmCo) and 303:1 (NdFeB). FIG. 14B illustrates how the latching force varies with the distance from the magnet (EPM) to the ferromagnetic plate.

Example 2

Figure 15:
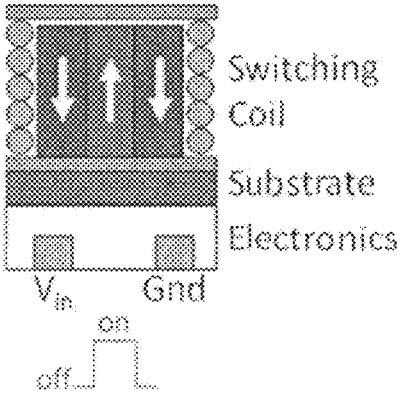
FIG. 15 shows a schematic of an electronically switchable magnet in accordance with the subject invention.

FIG. 15 shows a miniaturized and fully functional electronically switchable magnet. To reduce power consumption during switching, the EPM is fabricated using, low coercivity and high remanence switching magnets, such as alnico. The coil is shown positioned around the EPM core, with the electronics to provide current pulses to energize the coil positioned below the second shunt plate. All the components can be integrated and the fully functional system (EPM) can then be interconnected with a current source to switch the EPM.

Example 3

Figure 16:
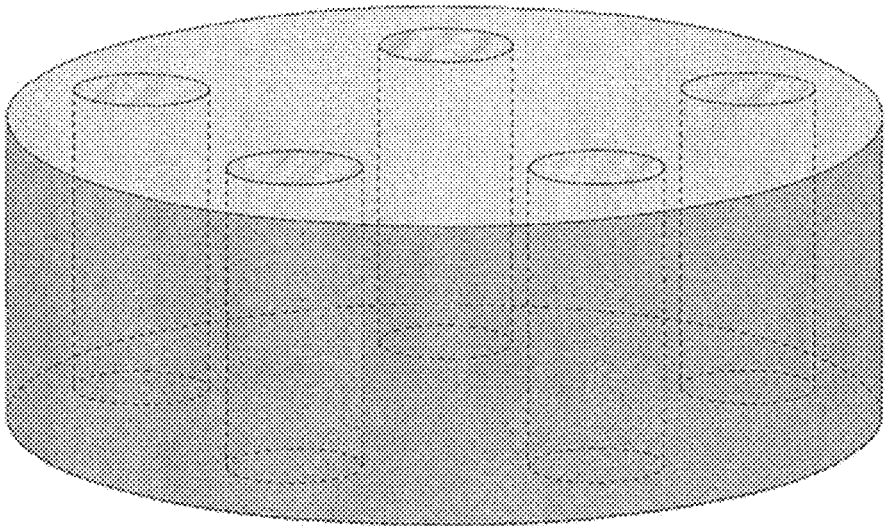
FIG. 16 shows an embodiment of an EPM core with multiple fixed magnets positioned with a corresponding multiple bores in the switching magnet.
Figure 17:
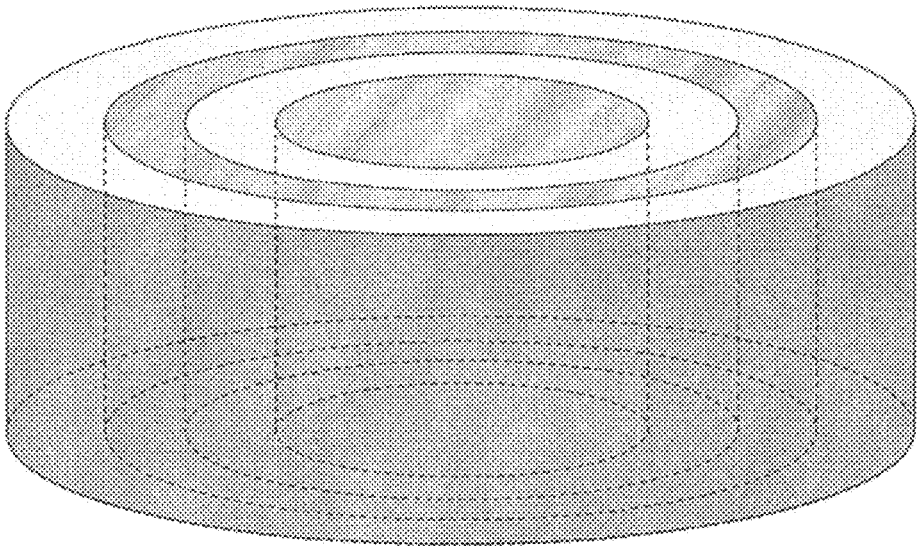
FIG. 17 shows an embodiment of an EPM core with a cylindrical fixed magnet portion and an annular ring shaped fixed magnet portion alternating with two annular ring shaped switching magnet portions.

Embodiments of the EPM core can have multiple bores, such as shown in FIGS. 16 and 17. FIG. 16 shows an embodiment of an EPM core with multiple fixed magnets positioned with a corresponding multiple bores in the switching magnet. FIG. 17 shows an embodiment of an EPM core where one bore in the switching magnet has a cylindrical shape (with a cylindrical shaped fixed magnet portion) and another bore in the switching magnet has an annular ring shape (with an annular ring shaped fixed magnet portion), such that the fixed magnet portions alternate with two annular ring shaped switching magnet portions.

Further, embodiments can have multiple "on states" by using two or more switching magnetic materials, and or applying the switching magnetic field to multiple portions of the EPM core.

In an embodiment, a second switching magnetic material can be positioned in a portion of each bore (e.g., the bottom half), a subset of bores (e.g., every other bore of n bores positioned in a radially symmetric pattern), or combination thereof, in a first switching magnetic material, and the fixed magnetic material can be positioned in the remaining portion of each bore (e.g., the top half), and the remaining bores (e.g., the other every other bore of the n bores positional in the radially symmetric pattern), and then subject to EPM core to a first switching magnetic field strong enough to switch the first switching magnetic material, or the second switching magnetic material, to create a "first on state," or subject to EPM core to a second switching magnetic field strong enough to switch both the first switching magnetic material and the second switching magnetic material, to create a "second on state."

In an embodiment, positioning multiple coils (to apply the switching magnetic field) can be positioned with respect to the EPM core, so that each coils only "reverses" a portion of the switching magnet when driven with the corresponding switching current, such that different combinations of coils can be driven to switch different combinations of portions of the switching magnet. In a specific embodiment, two coils, where a first coil switches a first portion of the switching magnet and a second coil switches a second portion of the switching magnet, can be used, where the switching magnetic flux due to the first portion of the switching magnet and the second portion of the switching magnet are different (e.g., the switching magnetic flux of first portion is ⅓ of the total switching magnetic flux and the switching magnetic flux of second portion is ⅔ of the total switching magnetic flux), such that by: switching the first portion of the switching magnet only; switching the second portion of the switching magnet only; or switching both portions of the switching magnet, one of three different "on-states" of the switchable magnet can be achieved (i.e., a "first on state" having ⅓ of the total switching magnetic flux; a "second on state" having ⅔ of the total switching magnetic flux; and a "third on state" having 3/3 of the total switching magnetic flux).

Example 4

This example relates to a method of operating an EPM in a manner to create a plurality of "on states" where a magnetization of the one or more switching magnets is different for each on state of the plurality of "on states." In an embodiment, the magnetization of the one or more switching magnets can vary from a magnetization having a maximum magnetization magnitude in a first direction to a magnetization having the maximum magnetization magnitude in a second direction, having an opposite direction to the first direction. When the magnetization of the one or more fixed magnets is in the second direction: the one or more switching magnets having a magnetization having the maximum magnetization magnitude in the first direction can be the off state of the EPM, and results in creating a minimum flux and minimum latching force; where the one or more switching magnets having a magnetization having fire maximum magnetization magnitude in the second direction can be the "maximum on state" of the EPM, and result in creating a maximum flux and maximum latching force. The EPM can be operated to also be switched to (transitioned to) one or more additional on states, where the one or more switching magnets have a magnetization having less than the maximum magnetization magnitude in the second direction for a magnetization having less than the maximum magnetization magnitude in the first direction). Each of these one or more additional on states results in a flux less than the maximum flux and a latching force less than the maximum latching force. Switching (or transitioning): from the off state to one of the on states: from one of the on states to another of the on states; or from one of the on states to the off state, is accomplished by applying a switching magnetic field having an appropriate magnitude and direction, and sufficient duration, where to transition from the off state to one of the maximum on state, or to transition from the maximum on state to one of the off state, a magnetic field having a switching magnitude at or above the magnitude of magnetic field that fully magnetizes the switching magnetic material is applied, and to transition from any state to any on state other than the maximum on state, a magnetic field having a switching magnitude below the magnitude of magnetic field that fully magnetizes the switching magnetic material, and has a magnitude corresponding to the desired state, is applied.

For an embodiment, such as disclosed in FIGS. 11A-11D, with a single fixed magnet and a single switching magnet, when the magnetization of the one or more fixed magnets is in the second direction, the off state of the EPM is when the switching magnet has a magnetization having the maximum magnetization magnitude for the switching magnet in the first direction, and the "maximum on state" of the EPM is when the switching magnet having a magnetization having the maximum magnetization magnitude for the switching magnet in the second direction. For embodiments having multiple switching magnets, the off state of the EPM is when each of the switching magnets has a magnetization having the maximum magnetization magnitude for that switching magnet in the first direction, and the "maximum on state" of the EPM is when each switching magnet has a magnetization having the maximum magnetization magnitude for that switching magnet in the second direction.

Embodiments

Embodiment 1. A switchable magnet, comprising:

a magnet assembly, wherein the magnet assembly comprises:

at least one fixed magnet having a first direction of magnetization from a south end of the at least one fixed magnet to a north end of the at least one fixed magnet, wherein the first direction of magnetization is in a first direction;

at least one switching magnet having a second direction of magnetization from a south end of the at least one switching magnet to a north end of the at least one switching magnet, wherein the at least one fixed magnet and the at least one switching magnet are permanent magnets, and wherein:

(i) one or more fixed magnets of the at least one fixed magnet are positioned within a corresponding one or more bores through a first switching magnet of the at least one switching magnet; or (ii) one or more switching magnets of the at least one switching magnet are positioned within a corresponding one or more bores through a first fixed magnet of the at least one fixed magnet; and a coil, wherein the coil is positioned with respect to the magnet assembly such that:

(i) when the second direction of magnetization is in the first direction and a first coil current is passed through the coil for a first period of time, a first coil created magnetic field is created that switches the second direction of magnetization from the first direction to a second direction, where the second direction is an opposite to the first direction, and does not switch the first direction of magnetization; and (ii) when the second direction of magnetization is in the second direction and a second coil current, where the second coil current is in an opposite direction to the first coil current, is passed through the coil for a second period of time, a second coil created magnetic field is created that switches the second direction of magnetization from the second direction to the first direction, and does not switch the first direction of magnetization:

a first shunt plate; and a second shunt plate, wherein the first shunt plate and the second shunt plate are positioned with respect to the magnet assembly such that:

(i) when the second direction of magnetization is in the first direction, an on state fixed magnetic flux exits out of the north end of the at least one fixed magnet and enters the first shunt plate, an on state switching magnetic flux exits out of the north end of the at least one switching magnet and enters the first shunt plate, and an on state external magnetic flux exits out of the first shunt plate and enters the second shunt plate, such that the on state external magnetic flux creates an on state external magnetic field; and (ii) when the second direction of magnetization is in the second direction, an off state magnetic flux exits out of the north end of the at least one fixed magnet and enters the first shunt plate, an off state switching magnetic flux exits out of the north end of the at least one switching magnet and enters the second shunt plate, and an off state external magnetic flux exits out of the first shunt plate and enters the second shunt plate, such that the off state external magnetic flux creates an off state external magnetic field.

Embodiment 2. The switchable magnet according to Embodiment 1, wherein the one or more fixed magnets of the at least one fixed magnet are positioned within the corresponding one or more bores through the first switching magnet of the at least one switching magnet.

Embodiment 3. The switchable magnet according to Embodiment 2.

wherein the one or more fixed magnets of the at least one fixed magnet is a first fixed magnet, and the at least one switching magnet is a first switching magnet of the at least one switching magnet, such that the first fixed magnet is positioned within a bore through the first switching magnet.

Embodiment 4. The switchable magnet according to Embodiment 3, wherein the first fixed magnet and the first switching magnet are concentric.

Embodiment 5. The switchable magnet according to Embodiments 3 or 4, wherein the first fixed magnet and the first switching magnet are coaxial.

Embodiment 6. The switchable magnet according to Embodiments 3, 4, or 5, wherein the on state switching magnetic flux is in a range of 95% to (1/0.95) % of the fixed on state magnetic flux.

Embodiment 7. The switchable magnet according to Embodiments 3, 4, 5, or 6, wherein the off state switching magnetic flux is in a range of 95% to (1/0.95) % of the on state switching magnetic flux.

Embodiment 8. The switchable magnet according to Embodiments 3, 4, 5, or 6, wherein the off state switching magnetic flux is in a range of 90% to (1/0.90) % of the on state switching magnetic flux.

Embodiment 9. The switchable magnet according to any of Embodiments 4-8, wherein the coil is positioned with respect to the magnet assembly such that:

(i) when the first coil current is passed through the coil for the first period of time, the first fixed magnet and the first switching magnet are exposed to the first coil created magnetic field; and (ii) when the second coil current is passed through the coil for the second period of time, the first fixed magnet and the first switching magnet are exposed to the second coil created magnetic field.

Embodiment 10. The switchable magnet according to any of Embodiments 4-8, wherein the coil is positioned with respect to the magnet assembly such that:

(i) when the first coil current is passed through the coil for the first period of time, the first switching magnet is exposed to the first coil created magnetic field, and the first fixed magnet is not exposed to the first coil created magnetic field; and (ii) when the second coil current is passed through the coil for the second period of time, the first switching magnet is exposed to the second coil created magnetic field, and the first fixed magnet is not exposed to the second created coil magnetic field.

Embodiment 11. The switchable magnet according to Embodiments 1-4, wherein the first fixed magnet is cylindrical is shaped.

Embodiment 12. The switchable magnet according to Embodiments 1-11, wherein the bore through the first switching magnet is cylindrically shaped.

Embodiment 13. The switchable magnet according to Embodiments 1-11, wherein the first switching magnet is cylindrically shaped.

Embodiment 14. The switchable magnet according to Embodiments 1-13, wherein the first shunt plate and the second shunt plate are cylindrically shaped, and wherein the first shunt plate and the second shunt plate are coaxial with the first fixed magnet and the first switching magnet.

Embodiment 15. The switchable magnet according to Embodiments 1-13, wherein the coil is cylindrically shaped.

Embodiment 16. The switchable magnet according to Embodiments 1-15, wherein the first coil created magnetic field is uniform within an interior of the coil, and the second coil created magnetic field is uniform within the interior of the coil.

Embodiment 17. The switchable magnet according to Embodiments 1-15, wherein the coil is positioned adjacent to an exterior surface of a side of the first switchable magnet.

Embodiment 18. The switchable magnet according to Embodiments 1-17, wherein the on state external magnetic field is symmetrical about a longitudinal axis of the switchable magnet, and wherein the off state external magnetic field is symmetrical about the longitudinal axis of the switchable magnet.

Embodiment 19. The switchable magnet according to Embodiments 1-17, wherein the on state external magnetic field is not symmetrical about a longitudinal axis of the switchable magnet, wherein, absent the presence of the first shunt plate and the second shunt plate, when the second direction of magnetization is in the first direction, an on state fixed magnetic flux exits out of the north end of the at least one fixed magnet and enters into the south end of the at least one fixed magnet, and an on state switching magnetic flux exits out of the north end of the at least one switching magnet and enters into the south end of the at least one switching magnet, so as to create an on state magnet assembly created external magnetic field, wherein the on state magnet assembly created external magnetic field is symmetrical about the longitudinal axis of the switchable magnet, wherein the off state external magnetic field is not symmetrical about the longitudinal axis of the switchable magnet, and wherein, absent the presence of the first shunt plate and the second shunt plate, when the second direction of magnetization is in the second direction, an off state fixed magnetic flux exits out of the north end of the at least one fixed magnet and enters into the south end of the at least one fixed magnet and/or the south end of the at least one switching magnet, and an off state switching magnetic flux exits out of the north end of the at least one switching magnet and enters into the south end of the at least one switching magnet and/or the south end of the at least one fixed magnet, so as to create an off state magnet assembly created external magnetic field, wherein the off state magnet assembly created external magnetic field is symmetrical about the longitudinal axis of the switchable magnet.

Embodiment 20. The switchable magnet according to Embodiments 3-19, wherein the first fixed magnet is made of NdFeB and the first switching magnet is made of Alnico.

Embodiment 21. The switchable magnet according to Embodiments 5-20, wherein the first fixed magnet has a length $L_F$ along a longitudinal axis of the first fixed magnet, wherein the first switching magnet has a length $L_S$ along a longitudinal axis of the first switching magnet, wherein $L_F$ is equal to $L_S$, and wherein longitudinal axis of the first switching magnet is coextensive with the longitudinal axis of the first fixed magnet.

Embodiment 22. The switchable magnet according to Embodiment 1, wherein the one or more switching magnets of the at least one switching magnet are positioned within the corresponding one or more bores through the first fixed magnet of the at least one fixed magnet.

Embodiment 23. The switchable magnet according to Embodiment 22, wherein the one or more switching magnets of the at least one switching magnet is a first switching magnet, and the at least one fixed magnet is a first fixed magnet of the at least one fixed magnet, such that the first switching magnet is positioned within a bore through the first fixed magnet.

Embodiment 24. The switchable magnet according to Embodiments 22-23, wherein the first fixed magnet and the first switching magnet are concentric.

Embodiment 25. The switchable magnet according to Embodiments 22-24, wherein the first fixed magnet and the first switchable magnet are coaxial.

Embodiment 26. The switchable magnet according to Embodiments 22-23, wherein the on state switching magnetic flux is in a range of 95% to (1/0.95) % of the on state fixed magnetic flux.

Embodiment 27. The switchable magnet according to Embodiments 22-23, wherein the off state switching magnetic flux is in a range of 95% to (1/0.95) % of the on state switching magnetic flux.

Embodiment 28. The switchable magnet according to Embodiments 22-23, wherein the off state switching magnetic flux is in a range of 95% to (1/0.95) % of the on state switching magnetic flux.

Embodiment 29. The switchable magnet according to Embodiments 22-23, wherein the coil is positioned with respect to the magnet assembly such that:

(i) when the first coil current is passed through the coil for the first period of time, the first fixed magnet and the first switching magnet are exposed to the first coil created magnetic field; and (ii) when the second coil current is passed through the coil for the second period of time, the first fixed magnet and the first switching magnet are exposed to the coil created second magnetic field.

Embodiment 30. The switchable magnet according to Embodiments 22-23, wherein the first switching magnet is cylindrically shaped.

Embodiment 31. The switchable magnet according to Embodiments 22-30, wherein the bore through the first fixed magnet is cylindrically shaped.

Embodiment 32. The switchable magnet according to Embodiments 22-31, wherein the first fixed magnet is cylindrically shaped.

Embodiment 33. The switchable magnet according to Embodiments 22-32, wherein the first shunt plate and the second shunt plate are cylindrically shaped, and wherein the first shunt plate and the second shunt plate are coaxial with the first fixed magnet and the first switching magnet.

Embodiment 34. The switchable magnet according to Embodiments 22-32, wherein the coil is cylindrically shaped.

Embodiment 35. The switchable magnet according to Embodiments 22-34, wherein the first coil created magnetic field is uniform within an interior of the coil, and the second coil created magnetic field is uniform within the interior of the coil.

Embodiment 36. The switchable magnet according to Embodiments 22-34, wherein the coil is positioned adjacent to an exterior surface of a side of the first fixed magnet.

Embodiment 37. The switchable magnet according to Embodiments 22-23, wherein the first fixed magnet is made of NdFeB and the first switching magnet is made of Alnico.

Embodiment 38. The switchable magnet according to Embodiments 22-25, wherein the first fixed magnet has a length $L_F$ along a longitudinal axis of the first fixed magnet, wherein the first switching magnet has a length $L_S$ along a longitudinal axis of the first switching magnet, wherein $L_F$ is equal to $L_S$, and wherein longitudinal axis of the first switching magnet is coextensive with the longitudinal axis of the first fixed magnet.

Embodiment 39. The switchable magnet according to Embodiments 22-23, wherein the first fixed magnet is made of NdFeB and the first switching magnet is made of Alnico.

Embodiment 40. The switchable magnet according to Embodiments 22-25, wherein the first fixed magnet has a length $L_F$ along a longitudinal axis of the first fixed magnet, wherein the first switching magnet has a length $L_S$ along a longitudinal axis of the first switching magnet, wherein $L_F$ is equal to $L_S$, and wherein longitudinal axis of the first switching magnet is coextensive with the longitudinal axis of the first fixed magnet.

REFERENCES

[1] A. N. Knaian, "Electropermanent Magnetic Connectors and Actuators: Devices and Their Application in Programmable Matter," Ph.D. Dissertation, Massachusetts institute of Technology, 2010, p. 206.

[2] K. Gilpin, A. Knaian, and D. Rus, "Robot pebbles: One centimeter modules for programmable matter through self-disassembly," Proc.—IEEE Int. Conf. Robot. Autom., pp. 2485-2492, 2010.

[3] N. A. Shirazee and A. Basak, "Electropermanent suspension system for acquiring large air-gaps to suspend loads," IEEE Trans. Magn., vol. 31, no. 6 pt 2, pp. 4193-4195, 1995.

[4] A. N. Knaian, K. C. Cheung, M. B. Lobovsky, A. J. Oines, P. Schmidt-Neilsen, and N. A. Gershenfeld, "The Milli-Motein: A self-holding chain of programmable matter with a one centimeter module pitch." IEEE Int. Conf. Intell. Robot. Syst., pp. 1447-1453, 2012.

[5] P. Ward and D. Liu, "Design of a high capacity Electro Permanent Magnetic adhesion for climbing robots." 2012 IEEE Int. Conf. Robot. Biomimetics, ROBIO 2012—Conf. Dig., pp. 217-222, 2012.

[6] K. U. Yoon and Y. W. Park, "Controllability of magnetic force in magnetic wheels," IEEE Trans. Magn., vol. 48, no. 11, pp. 4046-4049, 2012.

[7] F. Ochoa-cardenas and T. J. Dodd, "Design of an Active Magnetic Wheel with a Varying Electro-Permanent Magnet Adhesion Mechanism Enameled wire," pp. 3340-3345, 2015.

[8] S. Mintchev, R. Ranzani, F. Fabiani, and C. Stefanini, "Towards docking for small scale underwater robots," Auton. Robots, vol. 38, no. 3, pp. 283-299, 2014.

[9] Z. Bassett, M. Holdren, D. Vutetakis, A. Bass, H. Kwan, P. Finch, M. Darrow, A. Flock, and D. Tansel, "An Airborne Package Retrieval & Delivery System with Mechanized CG Relocation," in 16th AIAA Aviation Technology, Integration, and Operations Conference, American Institute of Aeronautics and Astronautics, 2016.

[10] J. Tugwell, P. Brennan, K. O'Shea, K. O'Donoghue, T. Power, M. O'Shea, J. Griffiths, R. Cahill, and P. Cantillon-Murphy, "Electropermanent magnetic anchoring for surgery and endoscopy," IEEE Trans. Biomed. Eng., vol. 62, no. 3, pp. 842-848, 2015.

[11] "Patent—Systems for Module Interfacing of Modular Mobile Electronic Dcvices.pdf."

[12] I. Chant, "Your phone will go to pieces," IEEE Spectr., vol. 52, no. 1, pp. 44-47, 2015.

[13] A. E. Israelson. U.S. Pat. No. 3,452,310, 24 Jun. 1969.
[14] F. Jurisch, World patent WO1997003911 A1, 20 Jul. 1996.
[15] J. I. Padovani, S. S. Jeffrey and R. T. Howe, "Electropermanent magnet actuation for droplet ferromicrofluidics, " *Technology*, vol. 4, 2016.
[16] Israelson A F 1965 Turn-off permanent magnet 2-4
[17] Jurish F 1996 Electrical permanent-magnet system for maneuvering a magnetic, particularly a ferromagnetic, load 24

The invention claimed is:

1. A method for switching a magnetic field external to a magnet assembly comprising:

providing the magnet assembly, wherein the magnet assembly comprises:

at least one fixed permanent magnet having a first direction of magnetization from a south end of the at least one fixed permanent magnet to a north end of the at least one fixed permanent magnet, wherein the first direction of magnetization is in a first direction;

at least one switching permanent magnet having a second direction of magnetization from a south end of the at least one switching permanent magnet to a north end of the at least one switching permanent magnet, and wherein one or more fixed permanent magnets of the at least one fixed permanent magnet are positioned at least partially within a corresponding one or more bores through a first switching permanent magnet of the at least one switching permanent magnet or one or more switchable permanent magnets of the at least one switching permanent magnet are positioned at least partially within a corresponding one or more bores through a first fixed permanent magnet of the at least one fixed permanent magnet, when the second direction of magnetization of the at least one switching permanent magnet is in the first direction, switching the second direction of magnetization from the first direction to a second direction by positioning an on-to-off switching magnetic field with respect to the magnet assembly for a first period of time, where the second direction is opposite to the first direction, wherein the positioning of the on-to-off switching magnetic field does not switch the first direction of magnetization the at least one fixed permanent magnet; and when the second direction of magnetization of the at least one switching permanent magnet is in the second direction, switching the second direction of magnetization from the second direction to the first direction by positioning an off-to-on switching magnetic field with respect to the magnet assembly for a second period of time, where the off-to-on switching magnetic field is in an opposite direction to the on-to-off switching magnetic field, wherein the positioning of the off-to-on switching magnetic field does not switch the first direction of magnetization of the at least one fixed permanent magnet.

2. The method of claim 1, further comprising:

positioning a first shunt plate with respect to a top of the magnet assembly such that:

when the second direction of magnetization is in the first direction, an on state fixed magnetic flux exits out of the north end of the at least one fixed permanent magnet and enters the first shunt plate, an on state switching magnetic flux exits out of the north end of the at least one switching permanent magnet and enters the first shunt plate, and an on state external magnetic flux exits out of the first shunt plate and enters a bottom of the magnet assembly, such that the on state external magnetic flux creates an on state external magnetic field; and when the second direction of magnetization is in the second direction, an off state magnetic flux exits out of the north end of the at least one fixed permanent magnet and enters the first shunt plate, an off state switching magnetic flux exits out of the north end of the at least one switching permanent magnet and enters the bottom of the magnet assembly, and an off state external magnetic flux exits out of the first shunt plate and enters the bottom of the magnet assembly, such that the off state external magnetic flux creates an off state external magnetic field.

3. The method of claim 2, wherein the on state external magnetic field is symmetrical about a longitudinal axis of the switchable magnet, and wherein the off state external magnetic field is symmetrical about the longitudinal axis of the switchable magnet.

4. The method of claim 1, further comprising:

positioning a first shunt plate and a second shunt plate with respect to the magnet assembly such that:

when the second direction of magnetization is in the first direction, an on state fixed magnetic flux exits out of the north end of the at least one fixed permanent magnet and enters the first shunt plate, an on state switching magnetic flux exits out of the north end of the at least one switching magnet and enters the first shunt plate, and an on state external magnetic flux exits out of the first shunt plate and enters the second shunt plate, such that the on state external magnetic flux creates an on state external magnetic field and when the second direction of magnetization is in the second direction, an off state magnetic flux exits out of the north end of the at least e fixed permanent magnet and enters the first shunt plate, an off state switching magnetic flux exits out of the north end of the at least one switching permanent magnet and enters the second shunt plate, and an off state external magnetic flux exits out of the first shunt plate and enters the second shunt plate, such that the off state external magnetic flux creates an off state external magnetic field.

5. The method of claim 4, wherein the one or more fixed permanent magnets of the at least one fixed permanent magnet is a first fixed permanent magnet and the at least one switching permanent magnet is a first switching permanent magnet of the at least one switching permanent magnet, such that the first fixed permanent magnet is positioned within a bore through the first switching permanent magnet, wherein the first switching permanent magnet is cylindrically shaped.

6. The method of claim 5, wherein the first shunt plate and the second shunt plate are cylindrically shaped, and wherein the first shunt plate and the second shunt plate are coaxial with the first fixed permanent magnet and the first switching permanent magnet.

7. The method of claim 1, wherein the one or more fixed permanent magnets of the at least one fixed permanent magnet are positioned within the corresponding one or more bores through the first switching permanent magnet of the at least one switching permanent magnet.

8. The method of claim 1, further comprising:

positioning a coil with respect to the magnet assembly such that:

when the second direction of magnetization is in the first direction and a first coil current is passed through the coil for the first period of time, the first coil creates the on-to-off switching magnetic field that switches the second direction of magnetization from the first direction to the second direction and does not switch the first direction of magnetization; and when the second direction of magnetization is in the second direction and a second coil current, where the second coil current is in an opposite direction to the first coil current, is passed through the coil for a second period of time, the second coil creates the off-to-on switching magnetic field that switches the second direction of magnetization from the second direction to the first direction and does not switch the first direction of magnetization.

9. The method of claim 8, further comprising integrating the coil with the magnet assembly.

10. The method of claim 8, wherein the first coil created magnetic field is uniform within an interior of the coil and the second coil created magnetic field is uniform within the interior of the coil.

11. The method of claim 10, further comprising positioning the coil adjacent an exterior surface of a side of the first switching magnet.

12. The method of claim 8, wherein the coil is separate from the magnet assembly.

13. The method of claim 12, wherein the one or more fixed permanent magnets of the at least one fixed permanent magnet is a first fixed permanent magnet and the at least one switching permanent magnet is a first switching permanent magnet of the at least one switching permanent magnet, such that the first fixed permanent magnet is positioned within a bore through the first switching permanent magnet.

14. The method of claim 13, wherein the first fixed permanent magnet and the first switching permanent magnet are coaxial.

15. The method of claim 13, wherein the first fixed permanent magnet and the first switching permanent magnet are concentric.

16. The method of claim 13, further comprising positioning the coil with respect to the magnet assembly such that:

when the first coil current is passed through the coil for the first period of time, the first fixed permanent magnet and the first switching permanent magnet are exposed to the first coil created magnetic field; and when the second coil current is passed through the coil for the second period of time, the first fixed permanent magnet and the first switching permanent magnet are exposed to the second coil created magnetic field.

17. The method of claim 13, further comprising positioning the coil with respect to the magnet assembly such that:

when the first coil current is passed through the coil for the first period of time, the first switching permanent magnet is exposed to the first coil created magnetic field, and the first fixed permanent magnet is not exposed to the first coil created magnetic field; and when the second coil current is passed through the coil for the second period of time, the first switching permanent magnet is exposed to the second coil created magnetic field, and the first fixed permanent magnet is not exposed to the second coil created magnetic field.

18. The method acclaim 13, wherein the first fixed permanent magnet is cylindrically shaped.

19. The method of claim 11, wherein the bore through the first switching permanent magnet is cylindrically shaped.

20. The method of claim 1, further comprising positioning the one or more switching magnets of the at least one switching magnet within the corresponding one or more bores through the first fixed magnet of the at least one fixed magnet.

* * * * *